US010293198B2

(12) United States Patent
Marti et al.

(10) Patent No.: US 10,293,198 B2
(45) **Date of Patent: *May 21, 2019**

(54) SHOULDER END RANGE OF MOTION IMPROVING DEVICE

(71) Applicant: T-Rex Investment, Inc., Atlanta, GA (US)

(72) Inventors: Eduardo M. Marti, Weston, FL (US); Robert T. Kaiser, South Hampton, NJ (US)

(73) Assignee: T-REX Investment, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/121,783

(22) Filed: Sep. 5, 2018

(65) Prior Publication Data

US 2019/0001174 A1 Jan. 3, 2019

Related U.S. Application Data

(60) Division of application No. 14/837,280, filed on Aug. 27, 2015, which is a continuation-in-part of (Continued)

(51) Int. Cl.
*A61H 1/02* (2006.01)
*A63B 21/00* (2006.01)
(Continued)

(52) U.S. Cl.
CPC ..... *A63B 21/00178* (2013.01); *A61H 1/0281* (2013.01); *A63B 21/0023* (2013.01);
(Continued)

(58) Field of Classification Search
CPC ..... A63B 21/00058; A63B 21/00069; A63B 21/00072; A63B 21/00076;
(Continued)

(56) References Cited

U.S. PATENT DOCUMENTS 4,566,692 A 1/1986 Brentham
4,772,015 A 9/1988 Carlson
(Continued)

FOREIGN PATENT DOCUMENTS

DE 102008053410 A1 * 4/2010 ..... A61H 1/0281
KR 20130025311 A * 3/2013 ..... A61H 1/0274
WO WO-2015058249 A1 * 4/2015 ..... A61F 5/00

OTHER PUBLICATIONS http://completeorthopedicservices.com/main/?slide=slide-3.
(Continued)

*Primary Examiner* — Gary D Urbiel Goldner
(74) *Attorney, Agent, or Firm* — David L. King

(57) ABSTRACT

A shoulder end range of motion improving device has a linkage, the linkage including a first link member, a second link member supported on the first link member, the second link member configured for being secured to an arm of a patient and being rotatable about a second link axis for rotating the arm of the patient about a shoulder joint of the patient through an arm range of motion, the second link axis being displaceable into a selectable fixed position, the fixed position being maintained during rotation of the second link member, an actuator for rotating the second link member about the second link axis, and a controller controlling the actuator for selectively rotating the second link member about the second link axis through the arm range of motion.

5 Claims, 28 Drawing Sheets

Related U.S. Application Data application No. 14/730,574, filed on Jun. 4, 2015, now Pat. No. 9,669,249.

(60) Provisional application No. 62/042,399, filed on Aug. 27, 2014, provisional application No. 62/007,541, filed on Jun. 4, 2014, provisional application No. 62/134,633, filed on Mar. 18, 2015.

(51) Int. Cl.

| | |
|---|---|
| ***A63B 23/12*** | (2006.01) |
| ***A63B 24/00*** | (2006.01) |
| ***A63B 71/00*** | (2006.01) |
| ***A63B 21/002*** | (2006.01) |
| ***A63B 23/035*** | (2006.01) |

(52) U.S. Cl.

CPC .... *A63B 21/00181* (2013.01); *A63B 21/4017* (2015.10); *A63B 21/4021* (2015.10); *A63B 21/4035* (2015.10); *A63B 21/4047* (2015.10); *A63B 21/4049* (2015.10); *A63B 23/03508* (2013.01); *A63B 23/1245* (2013.01); *A63B 23/1254* (2013.01); *A63B 23/1263* (2013.01); *A63B 23/1272* (2013.01); *A63B 24/0087* (2013.01); *A61H 2201/018* (2013.01); *A61H 2201/0184* (2013.01); *A61H 2201/123* (2013.01); *A61H 2201/1616* (2013.01); *A61H 2201/1633* (2013.01); *A61H 2201/1659* (2013.01); *A61H 2201/1676* (2013.01); *A61H 2201/501* (2013.01); *A61H 2201/5046* (2013.01); *A61H 2201/5061* (2013.01); *A61H 2201/5069* (2013.01); *A61H 2201/5097* (2013.01); *A61H 2203/0431* (2013.01); *A63B 2024/0093* (2013.01); *A63B 2071/0072* (2013.01); *A63B 2071/0081* (2013.01); *A63B 2208/0233* (2013.01); *A63B 2220/17* (2013.01); *A63B 2220/24* (2013.01); *A63B 2220/51* (2013.01); *A63B 2225/20* (2013.01); *A63B 2225/50* (2013.01)

(58) Field of Classification Search

CPC ..... A63B 21/00178; A63B 21/00181; A63B 21/002; A63B 21/0023; A63B 21/065; A63B 21/15; A63B 21/159; A63B 21/16; A63B 21/1609; A63B 21/4005; A63B 21/4017; A63B 21/4019; A63B 21/4021; A63B 21/4027; A63B 21/4029; A63B 21/4031; A63B 21/4033; A63B 21/4035; A63B 21/4039; A63B 21/4045; A63B 21/4047; A63B 21/4049; A63B 23/035; A63B 23/03508; A63B 23/12; A63B 23/1209; A63B 23/1245; A63B 23/1254; A63B 23/1263; A63B 23/1272; A63B 23/1281; A63B 23/129; A63B 24/0087; A63B 2024/0093; A63B 69/0057; A63B 69/0059; A63B 71/0054; A63B 2071/0063; A63B 2071/0072; A63B 2071/0081; A63B 2071/0675; A63B 2071/0683; A63B 2071/0686; A63B 2208/0228; A63B 2208/0233; A63B 2210/00; A63B 2210/02; A63B 2210/50; A63B 2220/10; A63B 2220/13; A63B 2220/16; A63B 2220/17; A63B 2220/24; A63B 2220/50; A63B 2220/51; A63B 2220/54; A63B 2220/62; A63B 2225/09; A63B 2225/093; A63B 2225/20; A63B 2225/50; A63B 2225/52; A61H 1/00; A61H 1/0274; A61H 1/0277; A61H 1/0281; A61H 2003/006; A61H 2201/00; A61H 2201/0119; A61H 2201/0149; A61H 2201/0138; A61H 2201/0173; A61H 2201/0176; A61H 2201/018; A61H 2201/0184; A61H 2201/0192; A61H 2201/12; A61H 2201/1207; A61H 2201/1215; A61H 2201/14; A61H 2201/1481; A61H 2201/149; A61H 2201/16; A61H 2201/1614; A61H 2201/1616; A61H 2201/1635; A61H 2201/1638; A61H 2201/1657; A61H 2201/1671; A61H 2201/1673; A61H 2201/1676; A61H 2201/50; A61H 2201/5007; A61H 2201/501; A61H 2201/5012; A61H 2201/5023; A61H 2201/5025; A61H 2201/5033; A61H 2201/5035; A61H 2201/5038; A61H 2201/5043; A61H 2201/5046; A61H 2201/5051; A61H 2201/5053; A61H 2201/5056; A61H 2201/5058; A61H 2201/5061; A61H 2201/5069; A61H 2201/5071; A61H 2201/5097; A61H 2203/04; A61H 2203/0431; A61H 2205/06; A61H 2205/062

See application file for complete search history.

(56) References Cited

U.S. PATENT DOCUMENTS

| | | | | |
|---|---|---|---|---|
| 4,930,770 | A | 6/1990 | Baker | |
| 4,957,281 | A | 9/1990 | Christolear | |
| 5,158,074 | A | 10/1992 | Grellas | |
| 5,163,451 | A | 11/1992 | Grellas | |
| 5,179,939 | A | 1/1993 | Donovan | |
| 5,320,641 | A | 6/1994 | Riddle et al. | |
| 5,403,251 | A | 4/1995 | Belsito et al. | |
| 5,417,643 | A | 5/1995 | Taylor | |
| 5,443,444 | A | 8/1995 | Pruyssers | |
| 5,919,148 | A | 7/1999 | Marko et al. | |
| 6,007,500 | A | 12/1999 | Quintinskle | |
| 6,301,526 | B1 | 10/2001 | Kim | |
| 7,695,416 | B2 | 4/2010 | Weiner | |
| 7,833,138 | B1 | 11/2010 | Fulks | |
| 7,862,524 | B2 | 1/2011 | Carignan et al. | |
| 8,277,396 | B2 | 10/2012 | Scott et al. | |
| 8,540,652 | B2 | 9/2013 | Tong et al. | |
| 9,456,951 | B2 | 10/2016 | Stevenot et al. | |
| 9,744,092 | B2 | 8/2017 | Fu et al. | |
| 2002/0082530 | A1 | 6/2002 | Knoll | |
| 2003/0115954 | A1 | 6/2003 | Zemlyakov | |
| 2004/0243027 | A1 | 12/2004 | Hook | |
| 2005/0049122 | A1 | 3/2005 | Vallone | |
| 2006/0040799 | A1 | 2/2006 | Pompile | |
| 2008/0041153 | A1 | 2/2008 | Tokita | |
| 2009/0149783 | A1 | 6/2009 | Nef et al. | |
| 2009/0264799 | A1 | 10/2009 | Bonutti et al. | |
| 2010/0145238 | A1 | 6/2010 | Stienen et al. | |
| 2010/0234776 | A1 | 9/2010 | Borden | |
| 2010/0249673 | A1 | 9/2010 | Nef et al. | |
| 2011/0237991 | A1* | 9/2011 | Bonutti ..... | A61F 5/013 602/16 |
| 2011/0251533 | A1 | 10/2011 | Han et al. | |
| 2012/0310118 | A1 | 12/2012 | Sarver et al. | |
| 2012/0330198 | A1 | 12/2012 | Patoglu | |
| 2013/0060171 | A1 | 3/2013 | Fu et al. | |
| 2013/0237883 | A1 | 9/2013 | Malosio et al. | |

(56) References Cited

U.S. PATENT DOCUMENTS

| | | | |
|---|---|---|---|
| 2014/0094721 | A1 | 4/2014 | Diallo |
| 2014/0336542 | A1 | 11/2014 | Fu et al. |

OTHER PUBLICATIONS http://www.getmotion.com/products-and-services/knees-and-ankles.
https://www.youtube.com/watch?v=OLvJwe5GAfg.
https://www.youtube.com/watch?v=KxyL35LVNZw.
https://www.premera.com/medicalpolicies/CMI_170374.htm.
http://www.medcomgroup.com/medcom-shoulder-cpm-2-week-rental-3-4-week-options-available/?gclid=Cj0KEQjwz6KtBRDwgq-LsKjM k9kBEiQAuaxWUoDxIHSLEEzljGr33vo1-CqoR9YIS3OWI9WVGUYI3aMaAhvO8P8HAQ.
www.rehabmart.com/product/centura-bed-wheelchair-shoulder-cpm-marchine-39996.html.

* cited by examiner

SHOULDER END RANGE OF MOTION IMPROVING DEVICE

CROSS-REFERENCE TO RELATED APPLICATIONS

This application is a division of U.S. patent application Ser. No. 14/837,280 filed on Aug. 27, 2015 which is a continuation-in-part of U.S. patent application Ser. No. 14/730,574, filed on Jun. 4, 2015 now U.S. Pat. No. 9,669, 249 issued on Jun. 6, 2017.

FIELD OF THE INVENTION

The present invention relates generally to shoulder range of motion therapy, and more particularly to a shoulder range of motion therapy device.

BACKGROUND OF THE INVENTION

A human shoulder is a ball and socket joint made up of three bones: the humerus, scapula (i.e. shoulder blade), and clavicle (i.e. collar bone). After certain injuries, surgery or other medical treatments that affect the mobility of the shoulder, it is customary for the patient to be prescribed physical therapy. For example after shoulder operation, scar tissue may form in shoulder joint tissue (i.e. arthrofibrosis) and as such, mobility of the shoulder may suffer. A patient who has undergone shoulder surgery may not be able to return to their normal daily activities without rehabilitative therapy. Studies have shown that prolonged immobilization after shoulder surgery or injury may cause irreversible changes in articular cartilage, inhibit circulation of synovial fluid, starve joint cartilage of nutrients, and promote the development of adhesions. Gradual loss of movement in a patients shoulder is sometimes referred to as "frozen shoulder".

Three cardinal planes are sometimes used to refer to a human body. A sagittal plane is perpendicular to the ground and divides a standing human body into left and right portions. A frontal plane is perpendicular to the ground and divides the body into posterior and anterior portions, extending laterally along a person's shoulder. A transverse plane is parallel to the ground and divides a body into upper and lower halves. Such planes may be used to define or describe an axis about which an action is performed. For example, a sagittal axis is defined as passing from posterior to anterior of a human body, formed by an intersection of sagittal and transverse planes. A frontal axis is defined as passing from left to right of a human body, formed by the intersection of frontal and transverse planes. A vertical axis passes vertically and is formed by the intersection of sagittal and frontal planes.

Commonly referenced arm motions provided by a shoulder joint are forward flexion and forward extension, abduction and adduction, internal rotation and external rotation, and horizontal abduction and horizontal adduction. For example, forward flexion and extension may describe motion performed about a frontal axis of the shoulder joint with motion in a sagittal plane. Abduction and adduction may describe motion performed about a sagittal axis of the shoulder joint with motion in a frontal plane. Horizontal abduction and horizontal adduction may describe motion performed about a vertical axis with motion in a transverse plane. Internal rotation and external rotation (or sometimes referred to as medial and lateral rotation respectively) may describe motion performed where a person's upper arm (the section of an arm from the elbow to the shoulder) rotates inward or outward about an axis extending along the upper arm through the shoulder joint (usually demonstrated with a bent elbow).

Commonly, a physician may prescribe therapeutic exercises to help a patient regain normal shoulder end range of motion. For example, a therapist may prescribe active range of motion (AROM) exercises, active assisted range of motion (AAROM) exercises, passive range of motion (PROM) exercises, and/or progressive resisted exercises (PRE) to help strengthen muscles surrounding the shoulder and break down scar tissue. AROM is defined as moving a body part without assistance of another. AAROM is defined as moving a body part with the assistance of another. PROM is defined as moving a body part with only the assistance of another. PRE are defined as movement of a body part against or opposing applied outside resistance.

As an example, to increase range of motion in the shoulder, a physical therapist may apply passive range of motion therapy. For example, to increase range of motion, the therapist may manually place appropriate rotational force on a patient's shoulder joint by rotating the patient's arm. After a desired force is achieved, the therapist may return the patient's arm to an original position to complete a cycle. Such therapy is applied on a frequent basis and maximum and minimum position angles are measured to quantify progress.

However, such manual methods are inconvenient because either the therapist or the patient has to travel on a frequent basis, possibly for many months. As such, shoulder therapy via a physical therapist is time-consuming, inefficient and costly.

Efforts may be made to train others, for example, the wife or husband of the patient, to perform these exercises. However, such training efforts have poor results, however, due to lack of patient and caregiver compliance and insufficient training to replicate the skill of a licensed therapist.

Such issues with manual methods have led to the development of machines that attempt to reproduce the capabilities of a licensed physical therapist, allowing therapy to be provided without requiring the patient or a therapist to travel and spend time providing therapy. For example, a therapy machine may be provided to a patient so that the patient may engage in therapy by themselves. However, current shoulder range of motion therapy machines have various problems. Common range of motion therapy machines individually are not able to provide end range of motion therapy for all of the above described motions, and as such, multiple different machines are required to be purchased to provide complete therapy. Further, common range of motion therapy machines are not appropriately configured for active therapy modalities. Furthermore, common range of motion therapy machines are not configured to record usage data, which may help track progress or check on patient compliance.

Therefore, there exists a need for a shoulder range of motion therapy machine or device that can rotate a shoulder of a patient to provide both active and passive range of motion therapies for all the above mentioned motions, and record usage data to track progress and check patient compliance

SUMMARY OF THE INVENTION

This summary is provided to introduce a selection of concepts in a simplified form that are further described below in the detailed description. This summary is not intended to identify key features of essential features of the claimed subject matter, nor is it intended to be used to limit the scope of the claimed subject matter. Furthermore, the claimed subject matter is not limited to implementations that solve any or all disadvantages noted in any part of this disclosure.

According to embodiments of the present disclosure an end range of motion improving device is disclosed comprising a linkage, the linkage including, a first link member, a second link member supported on the first link member, the second link member configured for being secured to an arm of a patient and being rotatable about a second link axis for rotating the arm of the patient about a shoulder joint of the patient through an arm range of motion, the second link axis being displaceable into a selectable fixed position and maintaining the fixed position during rotation of the second link member, an actuator for rotating the second link member about the second link axis, and a controller controlling the actuator for selectively rotating the second link member about the second link axis through the arm range of motion.

In another aspect, the fixed position is selectable by rotating the first link member about a first link member axis.

In another aspect, the second link axis is provided by a gear system.

In another aspect, the first link member independently rotates about a first link axis without causing the second link member to rotate about the second link axis, and the second link member independently rotates about the second link axis without causing the first link member to rotate about the first link axis.

In another aspect, the linkage includes one or more adjustment mechanisms to anatomically align the second link axis with the shoulder joint of the patient.

In another aspect, the gear system includes a polycentric gear system.

In another aspect, the controller registers time that the second link member spends at a particular position.

In another aspect, the controller registers force data from forces applied to the second link member.

In another aspect, the controller is configured to automatically hold the second link member at a particular position for a predetermined pause time.

In another aspect, the controller is configured to automatically rotatably cycle the second link member between a first position and a second position.

In another aspect, the controller is configured to automatically rotatably cycle the first link member between a first position and a second position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the claimed subject matter will hereinafter be described in conjunction with the appended drawings provided to illustrate and not to limit the scope of the claimed subject matter, where like designations denote like elements, and in which:

It is to be understood that like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 27:
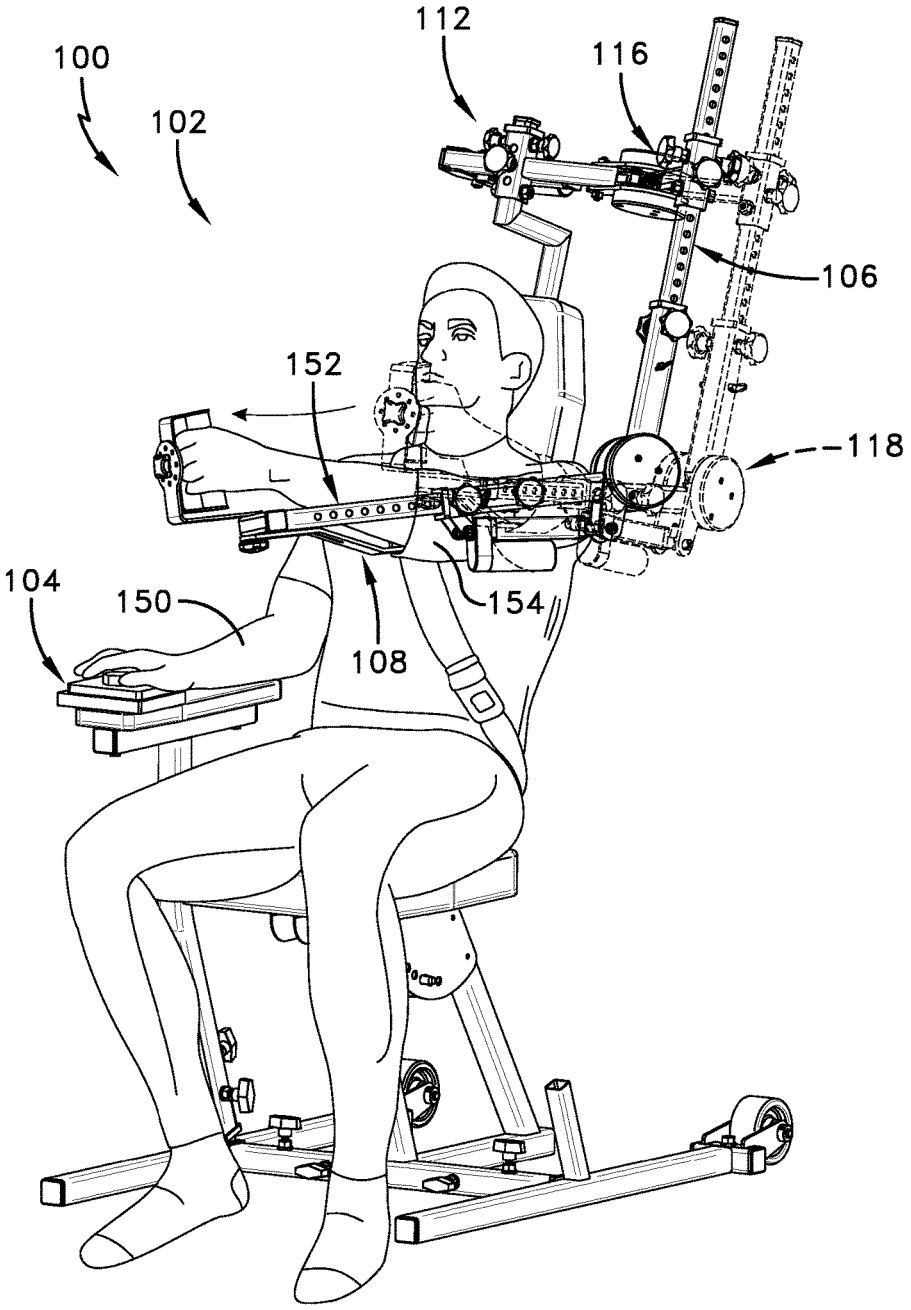

FIGS. 1-4 present a shoulder rehabilitation device 100 including a linkage 102 and a controller 104 for providing end range of motion therapy. The linkage 102 includes a first link member 106, a second link member 108, and a third link member 110. The linkage 102 may be attached to a support 112 which elevates and supports the link members during use. A seat 114 may be included on the support 112 to accommodate a patient. For example, the linkage 102 may be attached in an elevated fashion above the seat 114, or behind the seat 114. The seat 114 may include an adjustment mechanism to adjust an incline angle of the seat 114 (e.g. a backrest angle) during use. More particularly, the linkage 102 may be connected to a backrest of the seat 114, the linkage 102 including a support affixed to said backrest and disposed above the backrest. As such, one or more of the link member axes, such as first link member axis 116 may be disposed above the seat 114 above a patient's shoulder. The first link member axis 116 may provide an axis of rotation aligned with a patient's shoulder, perpendicular to the ground on which the device rests. For example, the first link member axis 116 may be disposed above a patient's shoulder providing an axis of rotation of the first link member 106 about a vertical axis, with motion in a transverse plane. Configuring the linkage 102 in this way (above and/or behind the backrest or seat 114) allows a user's arm to be rotated in a transverse plane (e.g. FIG. 27) across a patient's torso without the patient's leg, the seat 114, or the support 112 interfering with motion of the linkage 102 or link members. Similarly, supporting the linkage 102 above the backrest allows substantial retraction (i.e. horizontal rotation in the transverse plane behind a patient's back) without the linkage touching or contacting the patient, seat or support.

Figure 1:
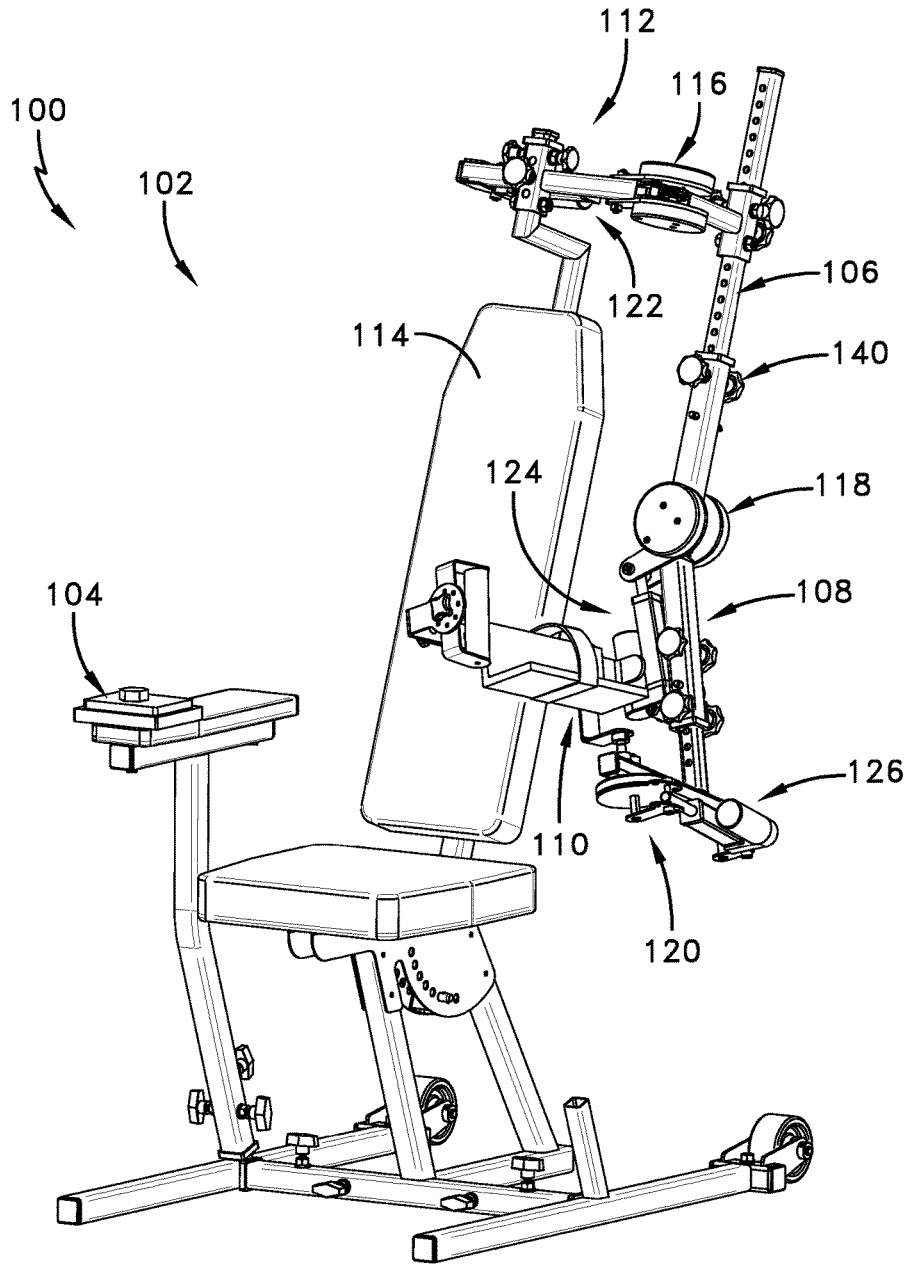
FIG. 1 shows a shoulder rehabilitation device from a perspective view.
Figure 2:
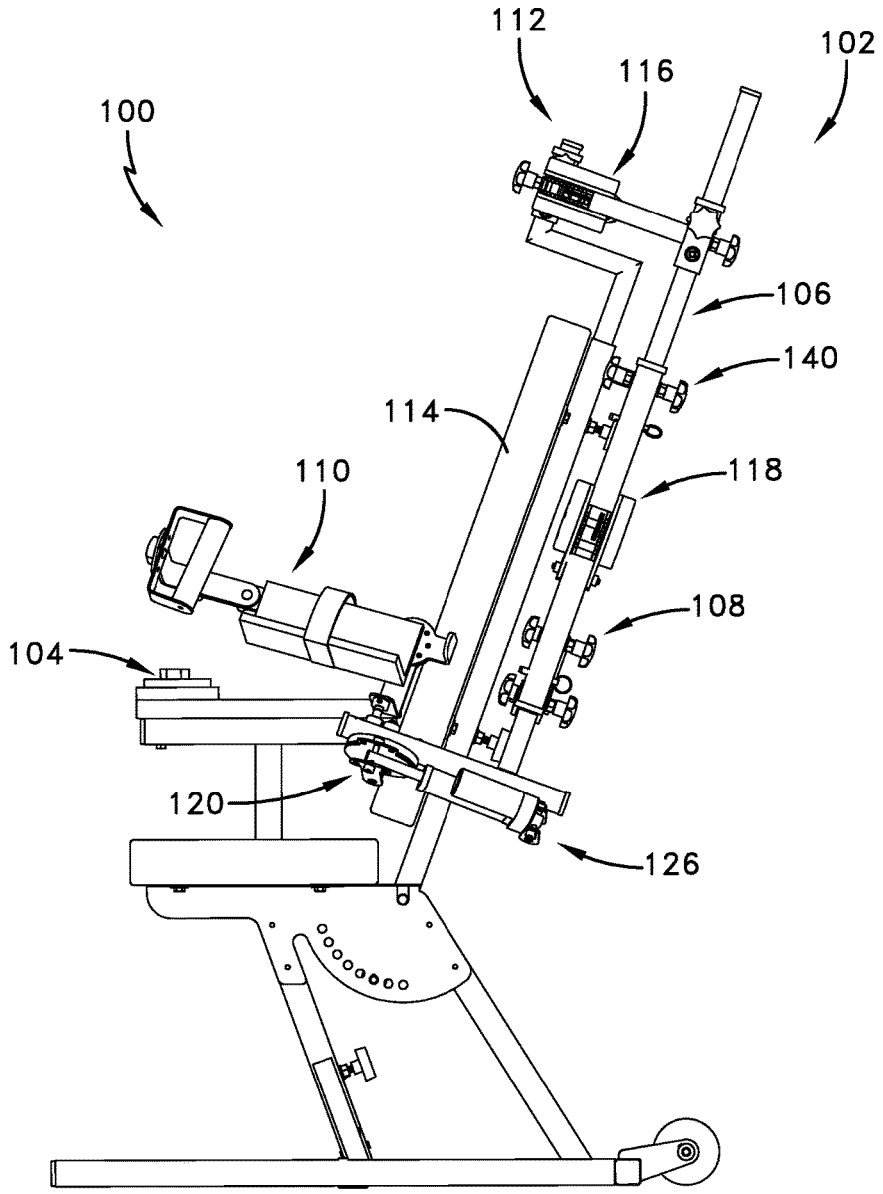
FIG. 2 shows the shoulder rehabilitation device from a side view.
Figure 3:
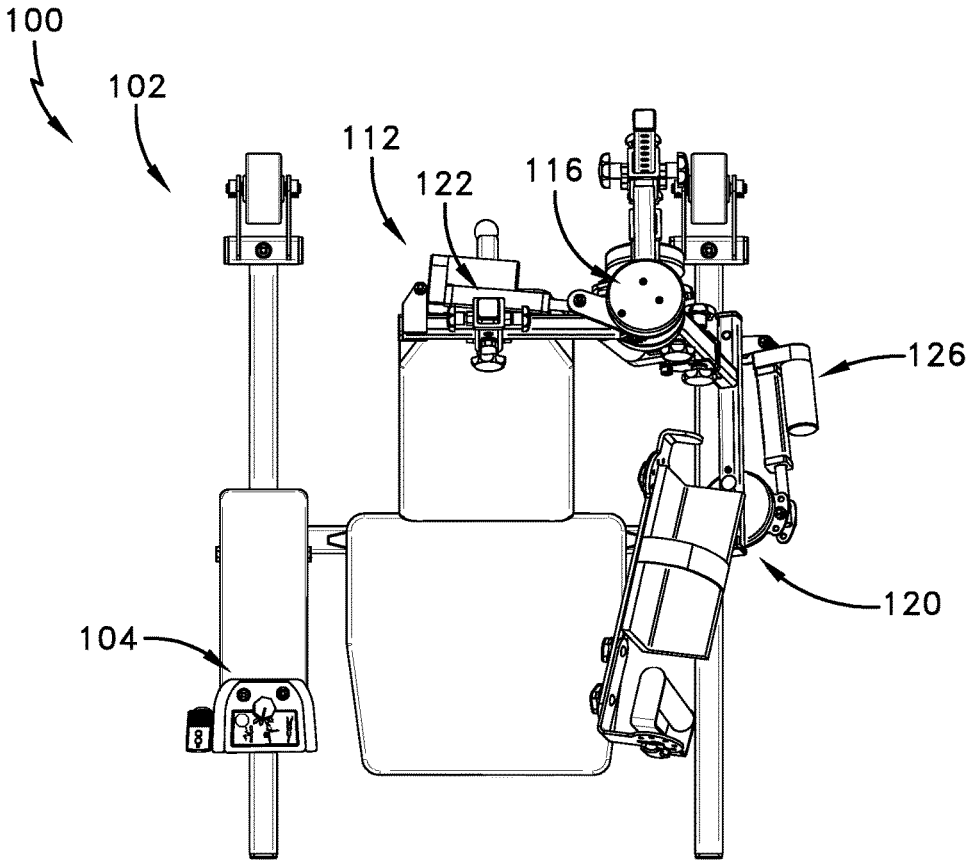
FIG. 3 shows the shoulder rehabilitation device from a top view.

FIGS. 1-3 further show one or more actuators and one or more link member axes for rotating a patient's arm about a shoulder joint through an arm range of motion. For example, first link member axis 116 is configured to rotatably attach the first link member 106 to the support 112, second link member axis 118 is configured to rotatably attach the second link member 108 to the first link member 106, and third link member axis 120 is configured to rotatably attach the third link member 110 to the second link member 108. A first actuator 122 is configured to drive the rotation of the first link member 106 about the first link member axis 116, a second actuator 124 is configured to drive the rotation of the second link member 108 about the second link member axis 118, and a third actuator 126 is configured to drive the rotation of the third link member 110 about the third link member axis 120. For example, the one or more actuators may be Geming®. brand linear actuators of any appropriate stroke length. The support 112 or seat 114 may be configured to provide clearance for the link members and actuators to pass behind or in front of the seat 114 or support 112 when the first link member 106 is rotated to horizontally retract (behind torso) or adduct (in front of torso) a patient's arm. Further, the second actuator 124 may be appropriately positioned on the first link member 106 or second link member 108 such that the second actuator 124 does not collide with the seat 114 or the support 112 during rotation of the link members.

The actuators may be positioned on the linkage 102 in various ways. For example, with respect to FIGS. 1 and 23, second actuator 124 may be positioned or disposed on first link member 106 or second link member 108 to actuate or drive the second link member axis 118 and subsequently rotate the second link member 108. When the second actuator 124 is disposed on the second link member 108, the actuator may run more efficiently or be more aesthetically appealing. For example, when the second actuator 124 is disposed on the second link member 108, the actuator "pushes" or "pulls" the second link member 108 directly, somewhat mimicking natural motion of a human body lifting a weight. Alternatively, when the second actuator 124 is disposed on the first link member 106 for rotating the second link member 108, the second actuator 124 drives the second link member axis 118 and subsequently or indirectly rotates or drives the second link member 108. The second actuator 124 being placed on the second link member 108 may run with less strain, thus prolonging the life of the actuator.

Figure 4:
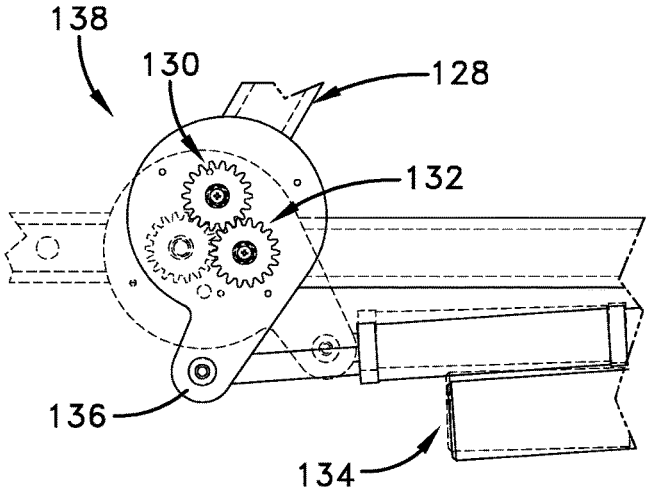
FIG. 4 shows a polycentric gear system included in the rehabilitation device.

The one or more link member axes may be polycentric gear systems to provide rotation of the link members. FIG. 4 shows an example of such a polycentric gear system 138, where outer gear 130 rotates about central gear 132 when actuator 134 rotates lever 136, causing the rotation of link member 128. For example, a first position of the polycentric gear system 138 is shown in dashed line, and a second position is shown in solid line. The lever 136 may be a hinge plate coupled to the actuator 134 and outer gear 130, and configured to be rotated when the actuator 134 is activated. Such a polycentric gear system 138 anatomically imitates or matches a rotating shoulder joint where the humeral head during arm elevation causes the clavicle to rotate upward. A polycentric hinge may reduce arm migration when an arm is rotated through a range of motion, reducing risk of further injury. In some cases, it is preferred that the head of a patient's humerus is aligned with the central gear 132. Alternatively, the one or more link member axes may be provided by simple hinges.

Turning back to FIG. 1-3, the link members may include adjustment mechanisms to anatomically match a patient's shoulder joint with the one or more link member axes. For example, first link member 106 may include adjustment mechanism 140. The included adjustment mechanisms may adjust an effective length of the respective link members via an adjustment pin disposed on a tubular member that slides into holes of another member insertable into the tubular member to secure a desired length of a link member.

Figure 5:
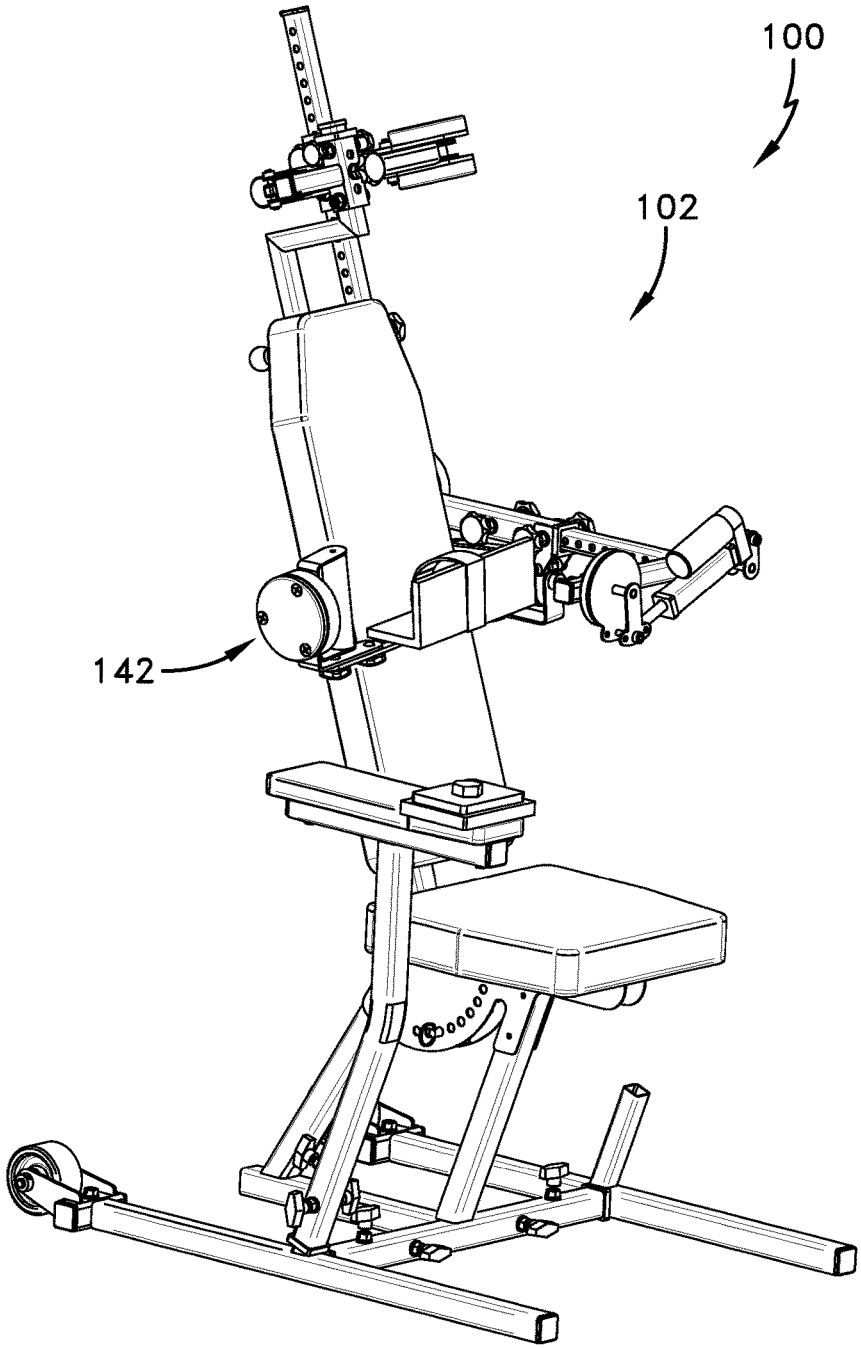
FIG. 5 shows an embodiment of the shoulder rehabilitation device including an axis for pronation and supination of a patient's forearm.

FIG. 5 shows another embodiment of the disclosed shoulder rehabilitation device, including a fourth axis 142 for providing pronation and supination (i.e. rotation) of a patient's forearm.

Figures 7, 7A, 7B, 7C:
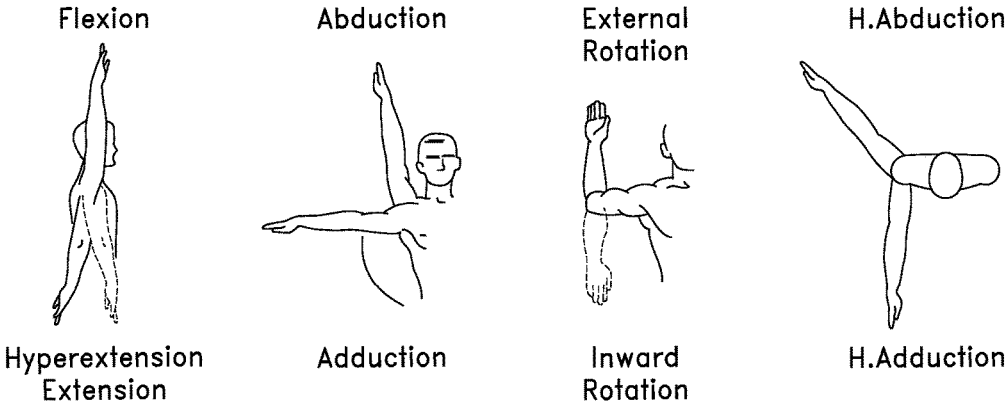
FIGS. 7-7C show various motions associated with shoulder rotation.
Figure 8:
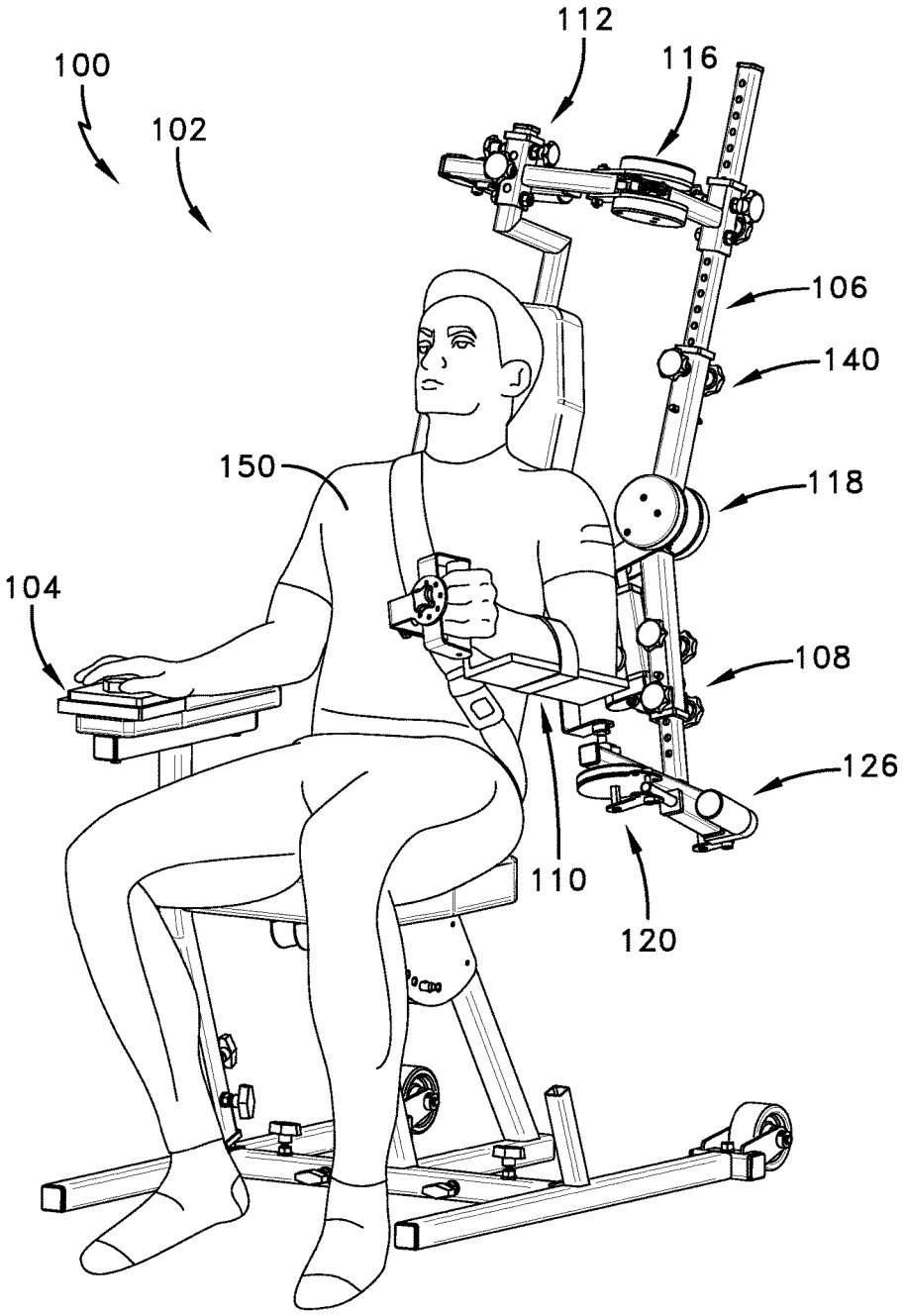
FIGS. 8-22 show a sequence of a patient using the shoulder rehabilitation device.
Figure 9:
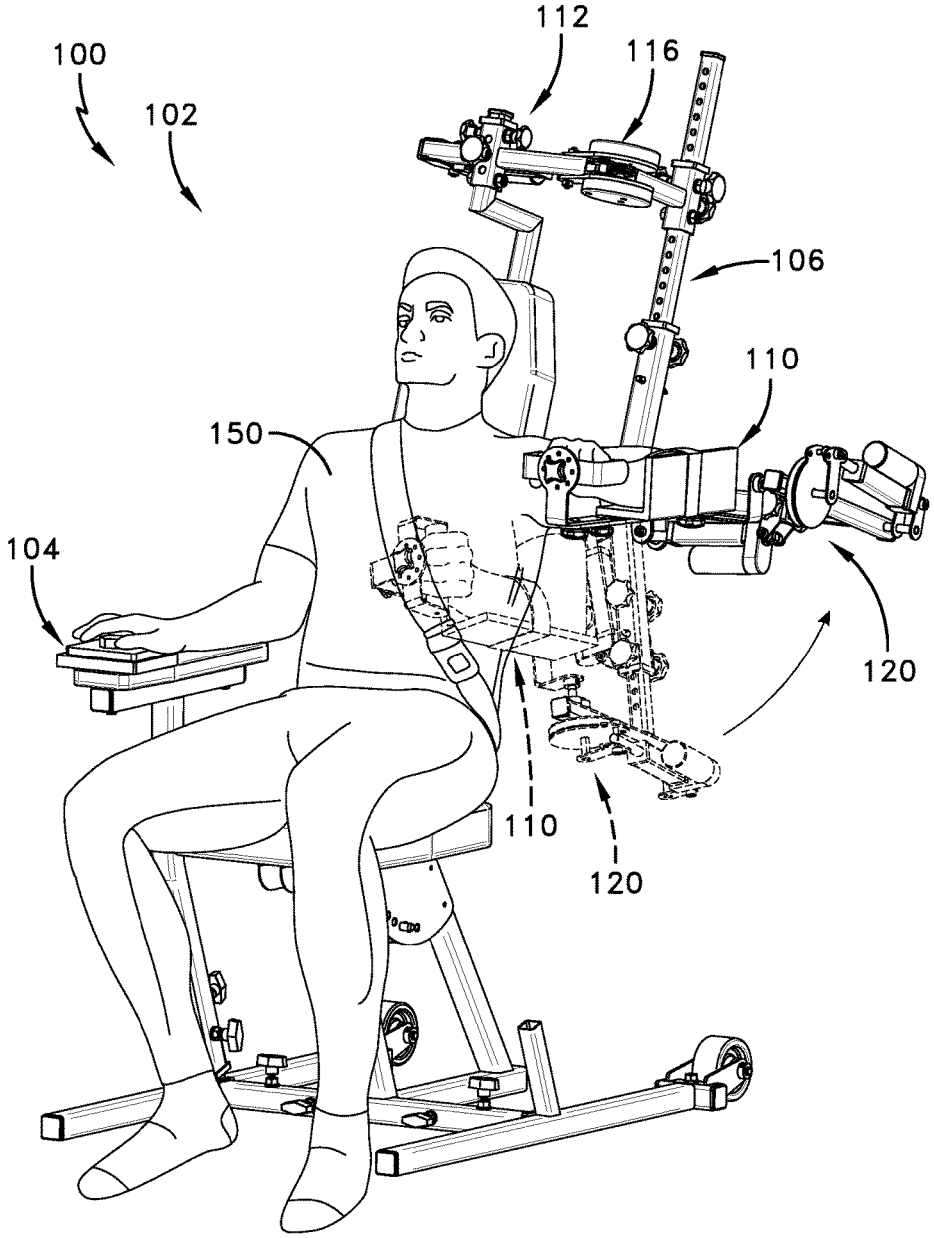
Figure 28:
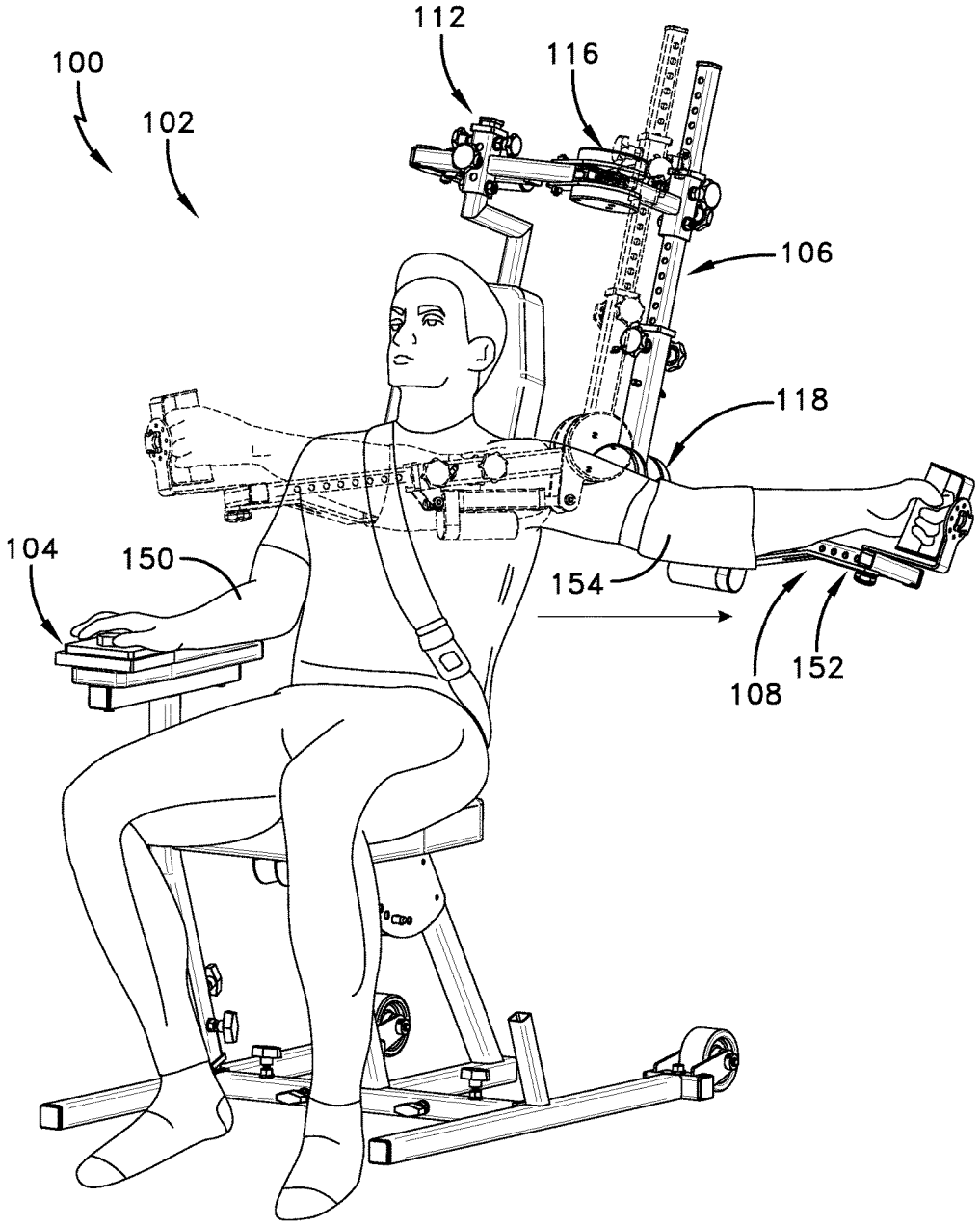
Figure 29:
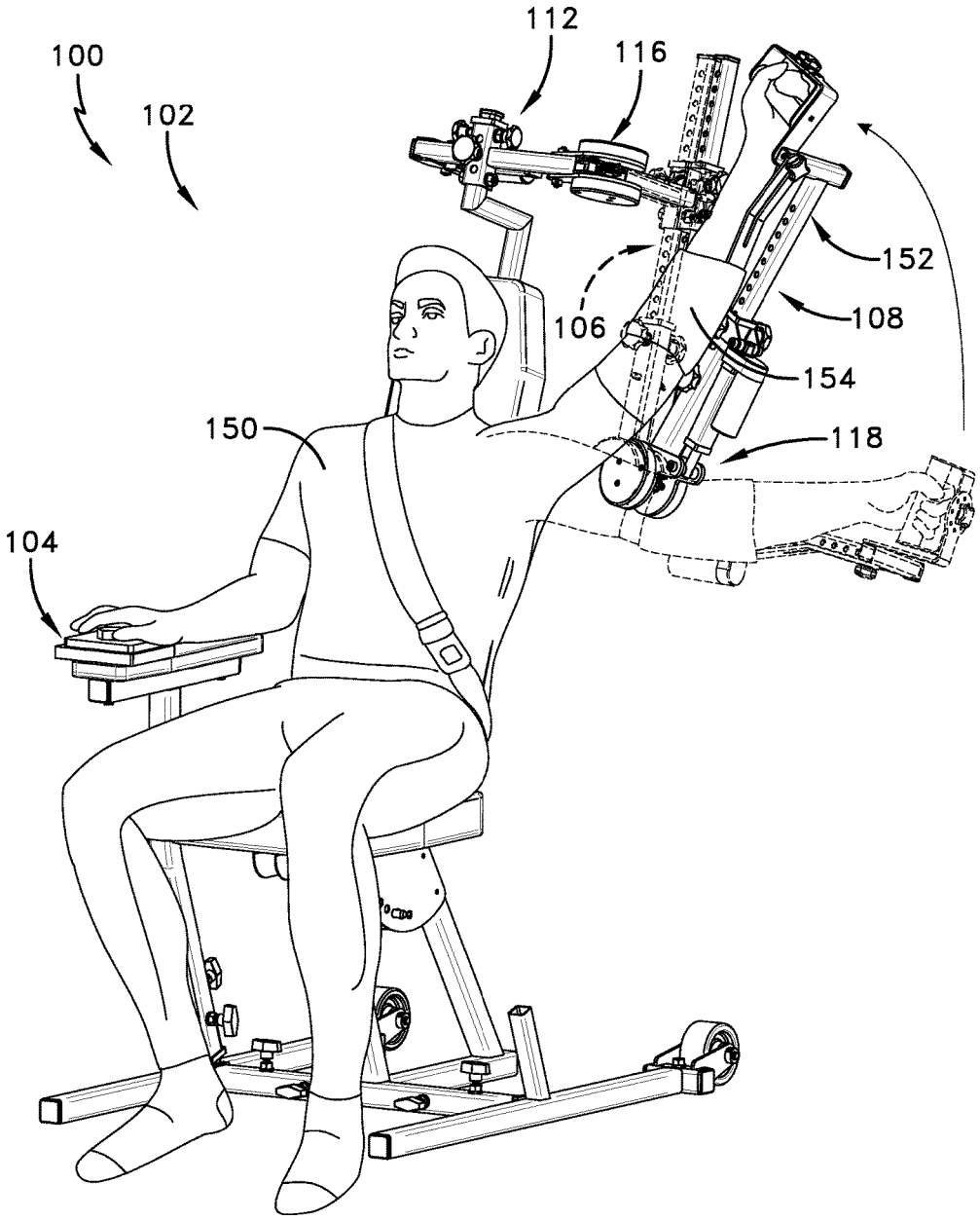
Figure 30:
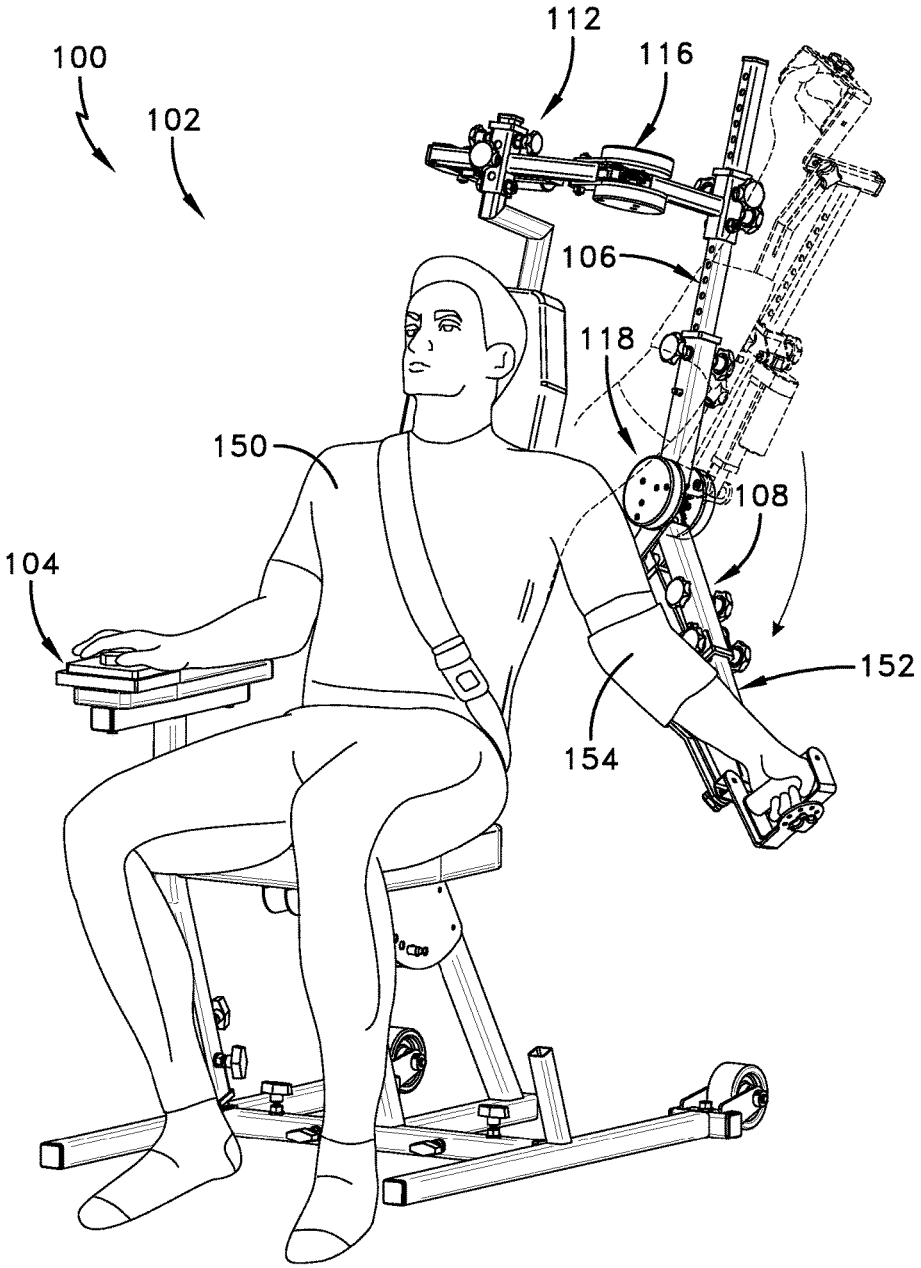

FIGS. 7-7C show various motions associated with shoulder rotation. For example, FIG. 7 shows an example of forward flexion and extension, FIG. 7A shows an example of abduction and adduction, FIG. 7B shows an example of internal (inward) rotation and external rotation, and FIG. 7C shows an example of horizontal abduction and adduction. In FIG. 7C, the patient is shown horizontally abducting their arm past the frontal plane, which is also known as retraction further shown in to FIG. 28.

Figure 6:
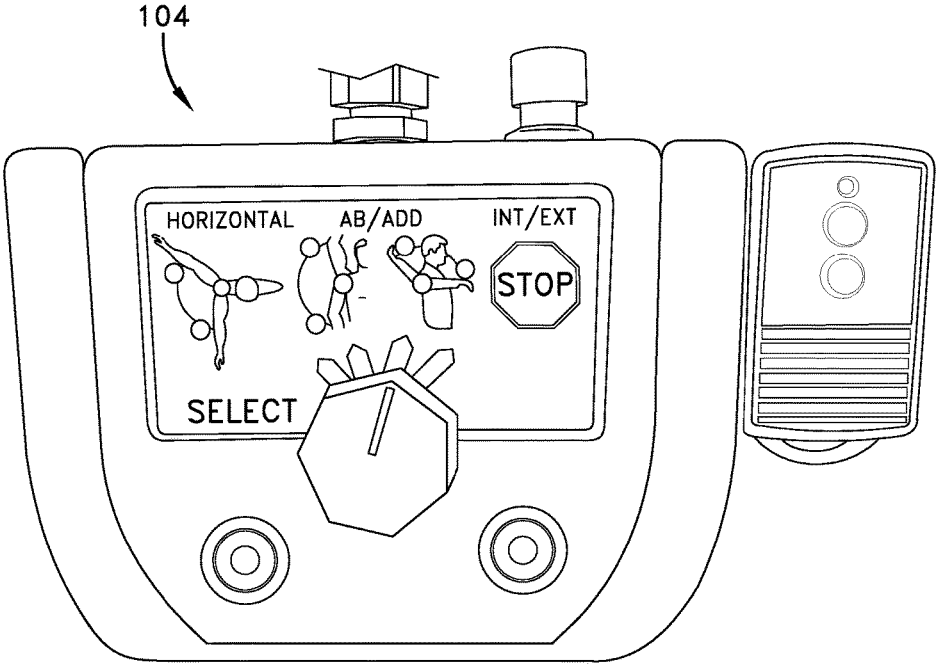
FIG. 6 shows an embodiment of a controller for controlling the shoulder rehabilitation device.

FIG. 6 shows the controller 104 that may be used to manually or automatically control the shoulder rehabilitation device 100 to drive the one or more actuators for rotating the link members independently. In an alternative embodiment, the controller may rotate two or more link members concurrently. Controller 104 is shown including a selector switch 144, directional buttons 146, and display 148. For example, the selector switch 144 may be operated between various positions to select which of the above axes is to be rotated. For example, one selectable position may be configured to rotate the first link member 106, one selectable position may be configured to rotate the second link member 108, and one selectable position may be configured to rotate the third link member 110. Directional buttons 146 are configured to each rotate a selected link member in a particular direction. For example, one directional button may rotate a link member clockwise, while another directional button may rotate a link member counter-clockwise. In some embodiments, a joystick may be included to rotate the link members. An emergency stop button or selection may also be included.

In some embodiments, the controller 104 may be configured to receive user input, and may include a computing system to process information to carry out rotation tasks. For example, the display 148 may be configured to display various usage data, parameters, instructions or indicators relating to usage of the shoulder rehabilitation device 100. Usage data may include time the shoulder rehabilitation device 100 is used, sensed force data applied from or to the arms of a patient, maximum and minimum angles reached from rotation of the link members, user input data, time a particular angle is held, and/or number of cycles completed of a particular therapy exercise. User input may be received via a touch screen LCD display or various tactile or virtual buttons, and may include various parameters for the computing system to carry out automatic cycling of rotation, or limit maximum or minimum angles of rotation or forces. For example, the controller may receive input control signals locally or remotely to automatically cycle the rotating of a link member through predetermined rotation limits or predetermined force limits. For example, the link member axes or the link members may include force sensors to determine forces involved in the rotation of a patients arm, or positions or angles of the link members. The display 148 may display angle readout information for current angles of the link members, or current arm motions or positions. The controller 104 may be connected to a network such that the controller 104 may receive computer instructions from the network, may be controlled remotely via a remote device, or may upload or send usage report data to a server on the network for further processing. For example, the controller 104 may be connected to a computer network such that the controller 104 may be shut down or such that rotation parameters may be adjusted or inputted by a doctor or authorized professional. Further, a current location of the shoulder rehabilitation device 100 may be uploaded via the computer network. For example controller 104 may receive input controls or parameters to remotely or locally automatically cycle rotating one or more of the link members through predetermined rotation limits, or predetermined force limits. The controller 104 may be set to automatically cycle between a range of motion while holding a particular angle for a particular time at various angle increments while remaining within a certain force threshold. The controller may automatically stop rotating when the controller 104 is supplied data indicating the passing of a predetermined force or rotation threshold. The controller may include various wireless or Bluetooth communication devices to wirelessly connect to the computer network or personal computing devices such as mobile phones. Further, the controller 104 may include more than one controller, such as a slave controller hard wired to the shoulder rehabilitation device 100 or a wireless pendant that controls the slave controller, the pendant being conveniently locatable in a user's hand. Additionally, the controller may include an "abort" button or function that disengages rotation if a patient experiences extreme discomfort or injury, or if the shoulder rehabilitation device malfunctions. Such an abort button may send signals to reverse or stop forces applied to a patients arm. Force or angle data provided by the various sensors may be processed by the shoulder rehabilitation device 100 to provide various exercise modes to a patient. For example, a patient may be prescribed to engage in isometric exercises. To apply isometric exercise, a patient may be indicated by the display 148 or by a physical therapist to apply force via their arm to one of the link members to determine a patient's strength or progress. Further, a patient may be indicated by a health professional to engage in contract relax therapy, where a patient presses against a link member in an opposite direction of link member rotation such that the patient's muscles and tendons increase range of motion and a "stretch reflex" is minimized. Such contract relax therapy may be provided via sensing forces and angles via the various sensors mentioned above. Further, eccentric or concentric exercise may be prescribed to a patient. For example, eccentric exercise may include a patient pressing against a link member while simultaneously rotating the link member in an opposite direction to the applied force. On the other hand, concentric exercise may include a patient applying a force to a link member while rotating the link member in a same direction of the applied force.

Figure 10:
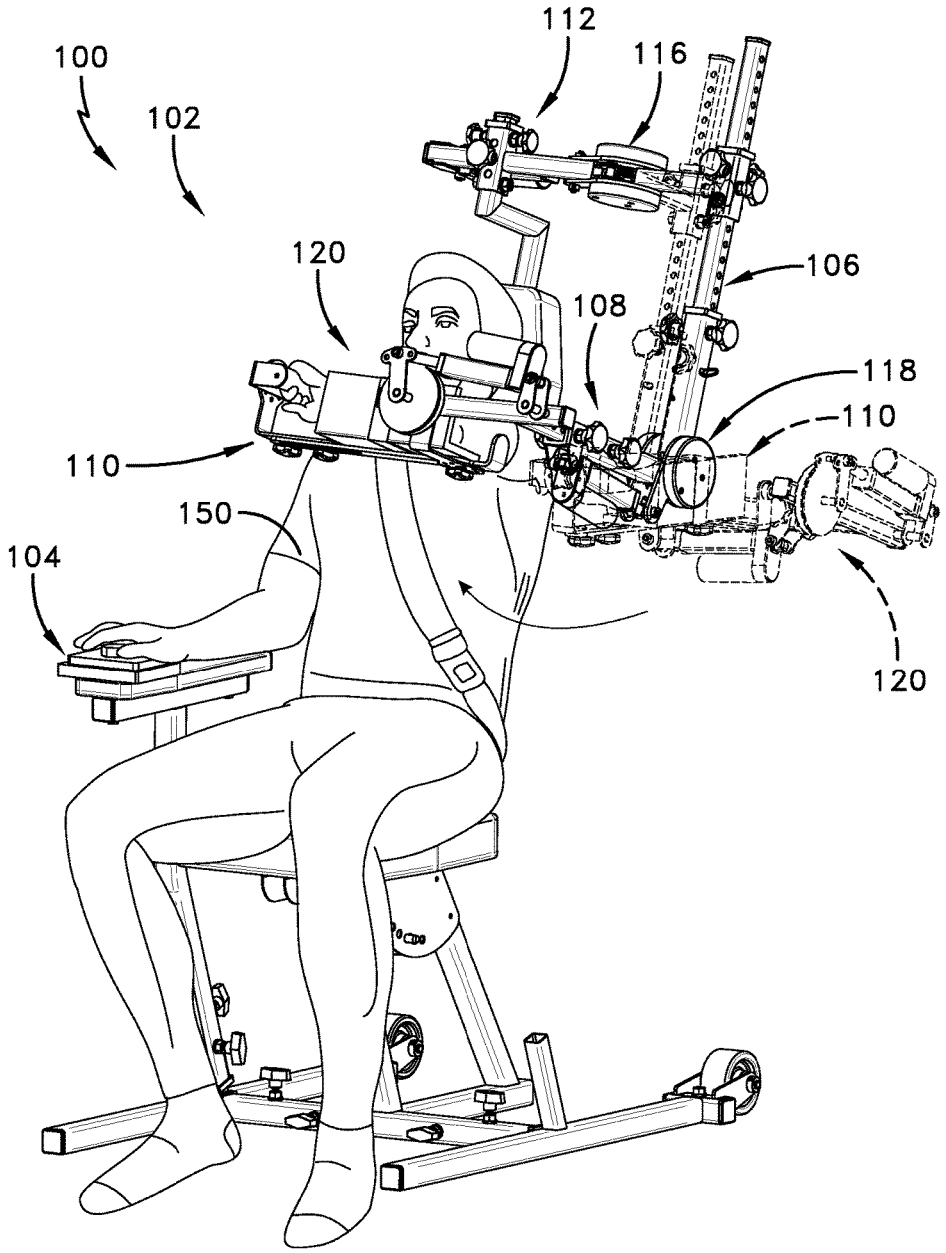
Figure 11:
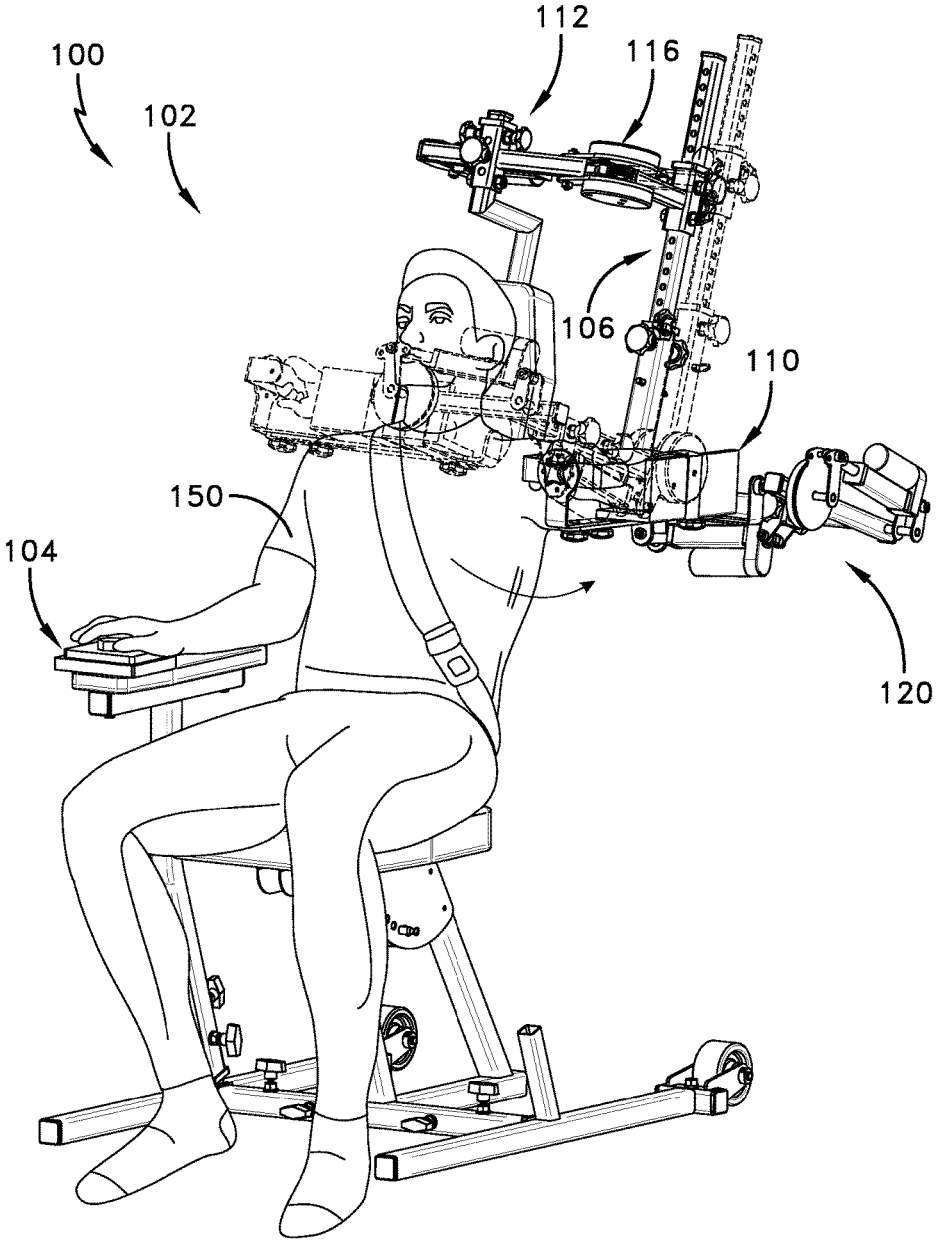
Figure 12:
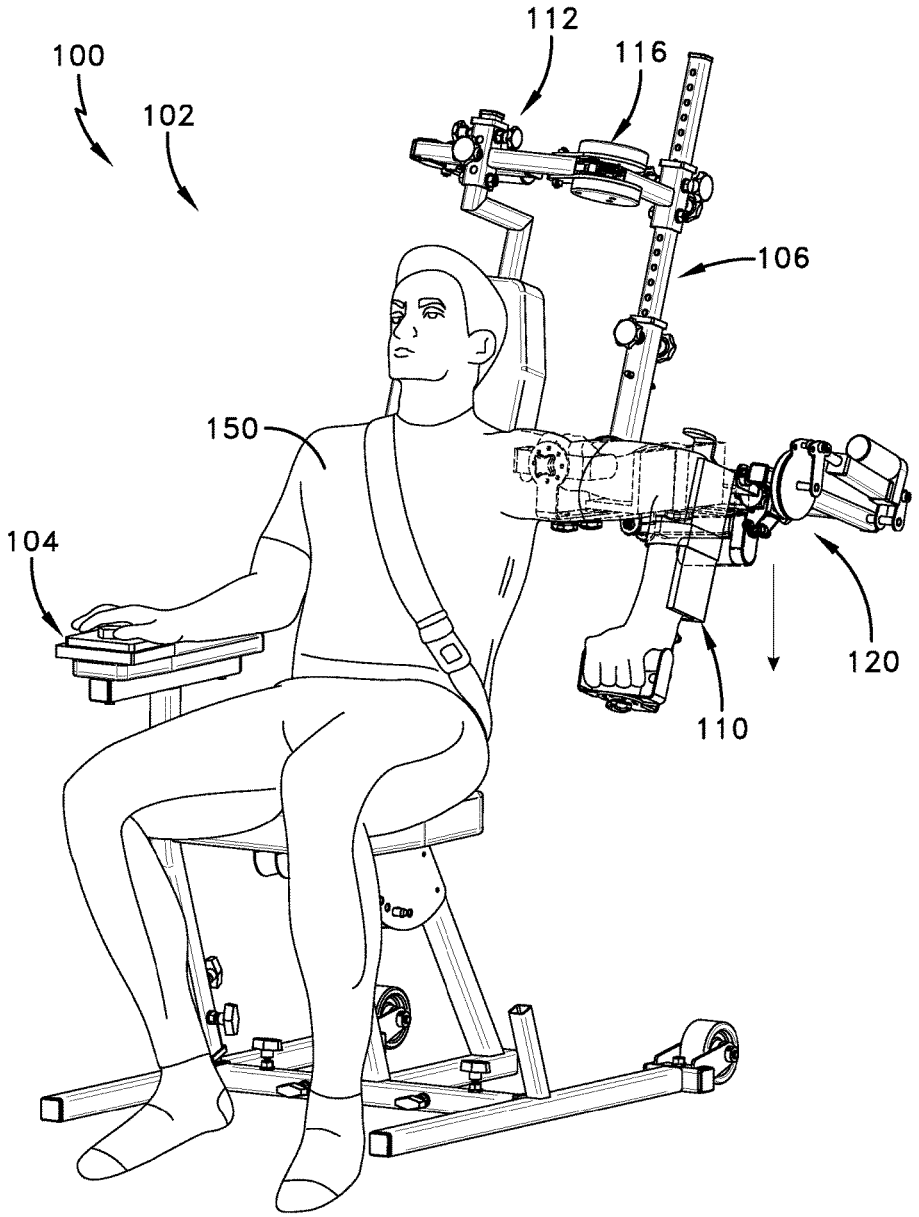
Figure 13:
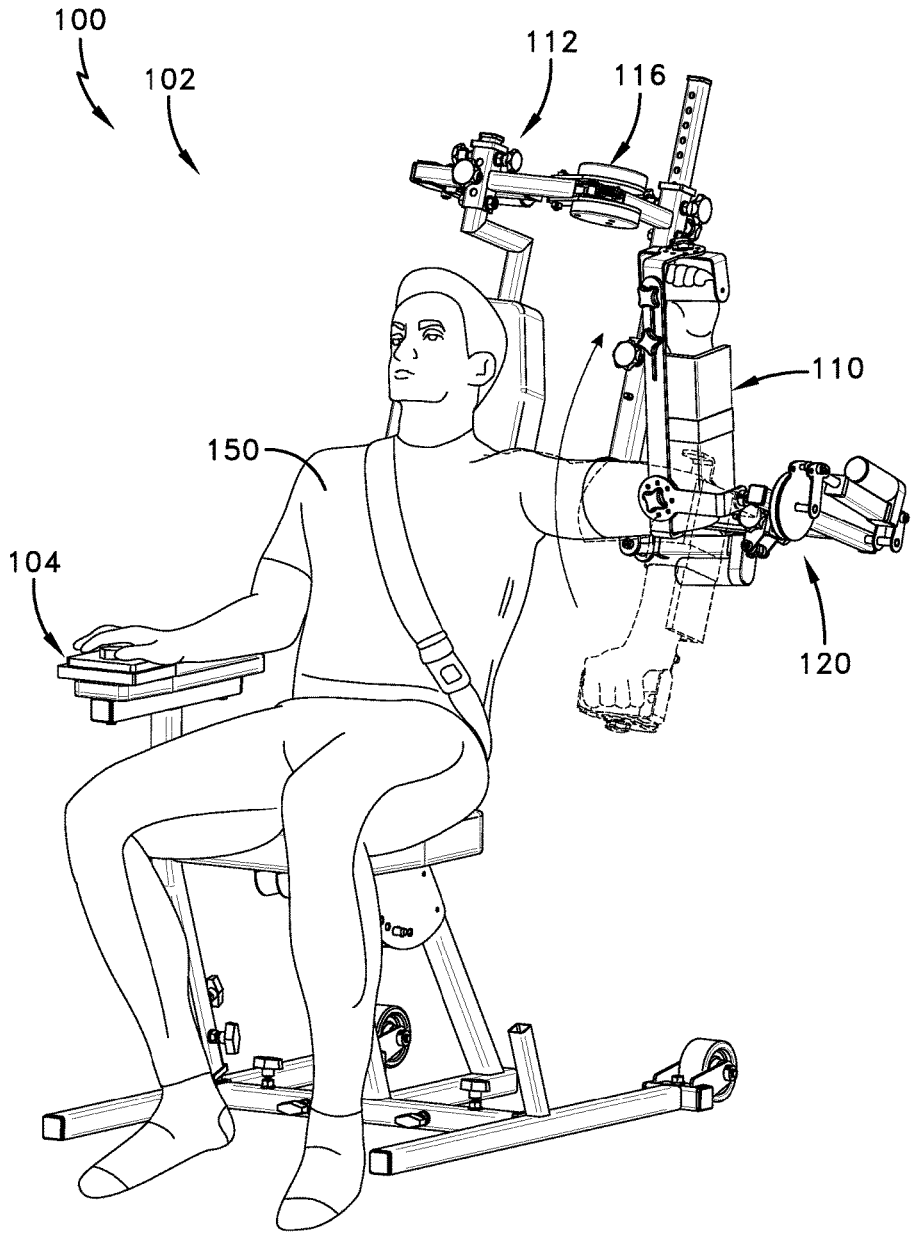
Figure 14:
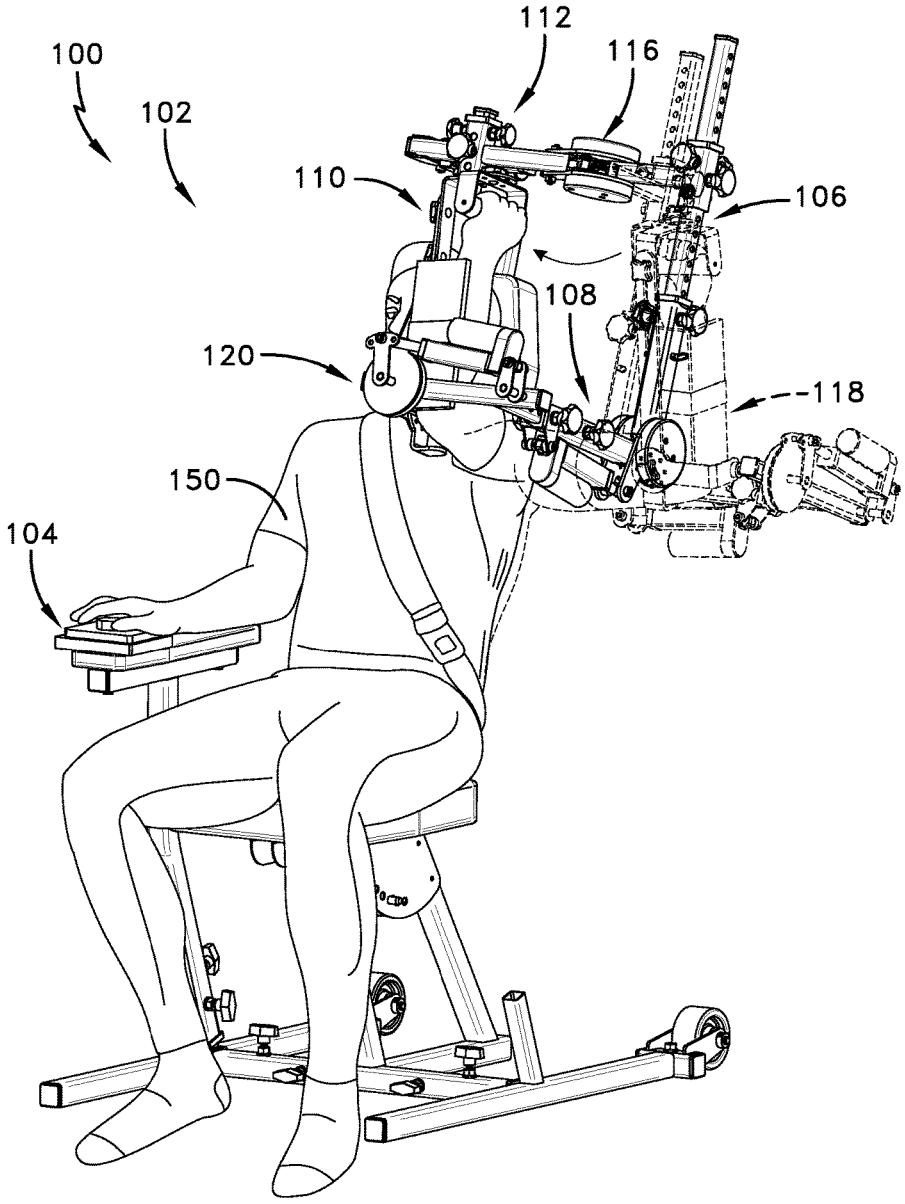
Figure 15:
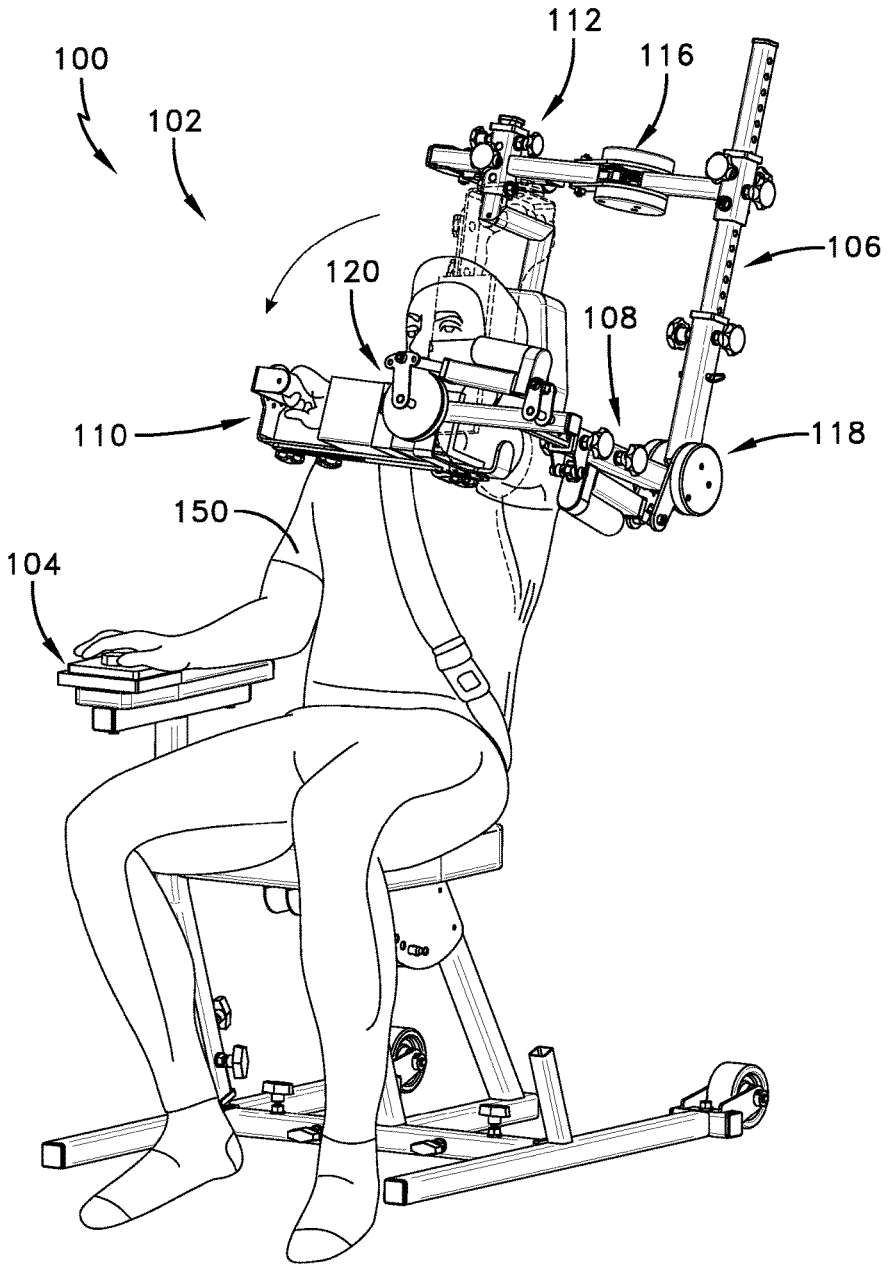
Figure 16:
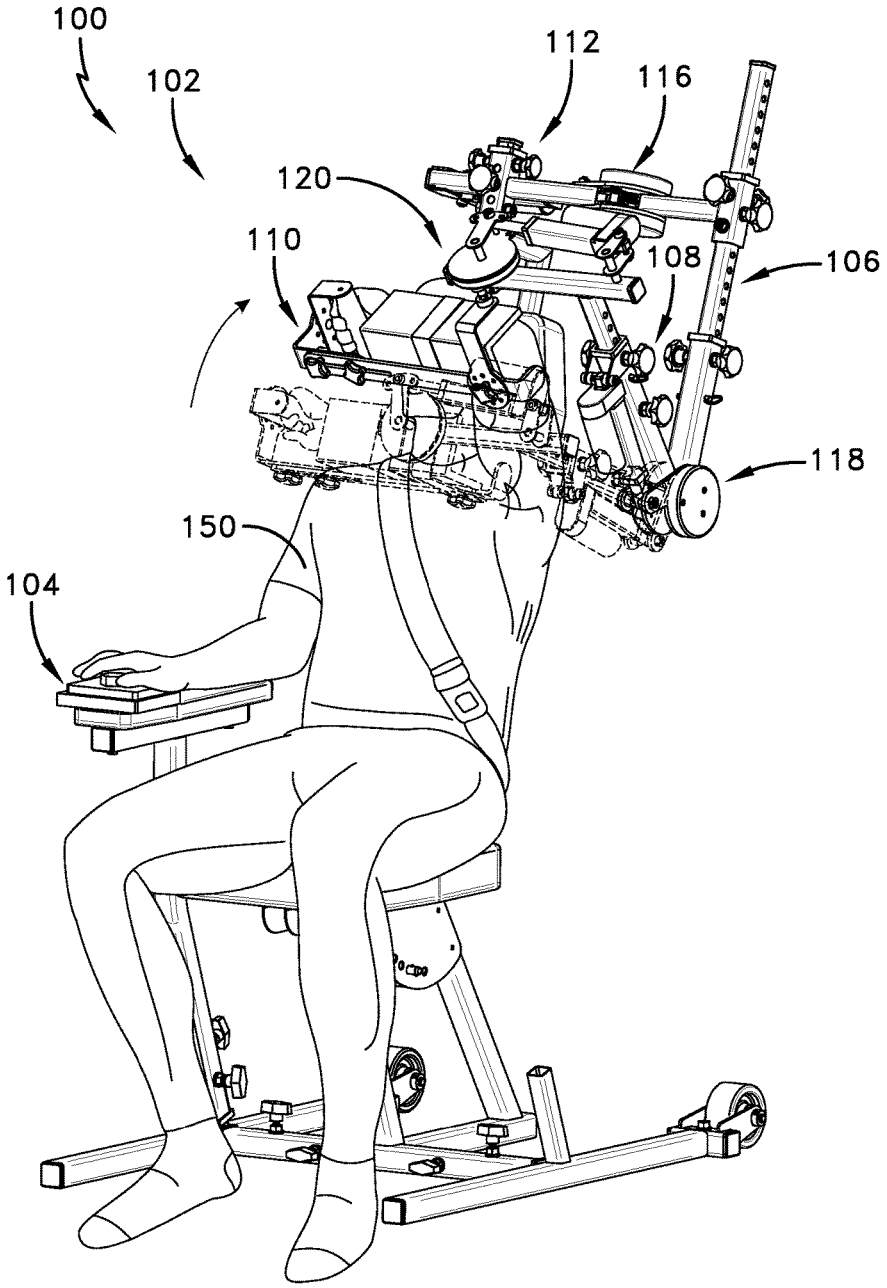
Figure 17:
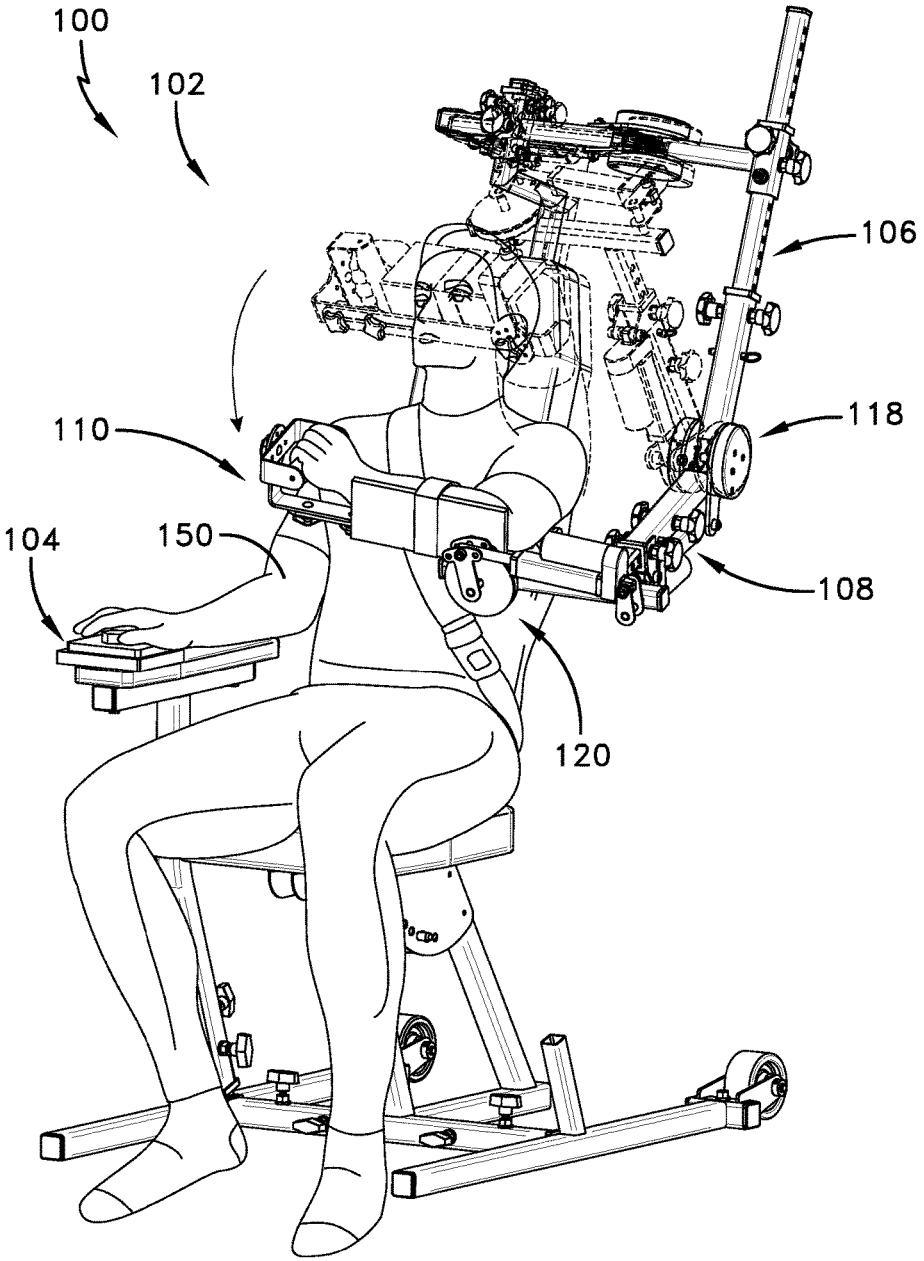
Figure 18:
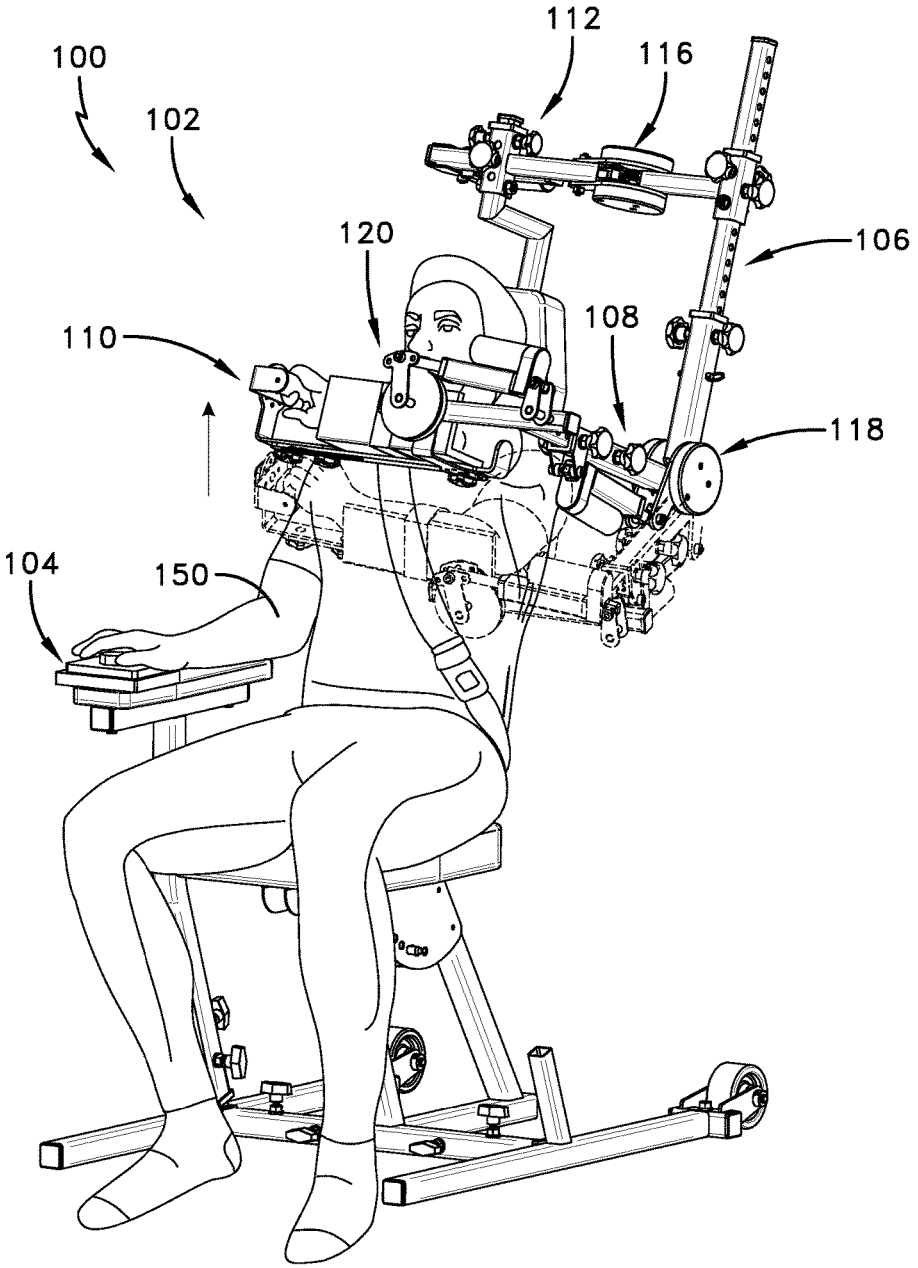
Figure 19:
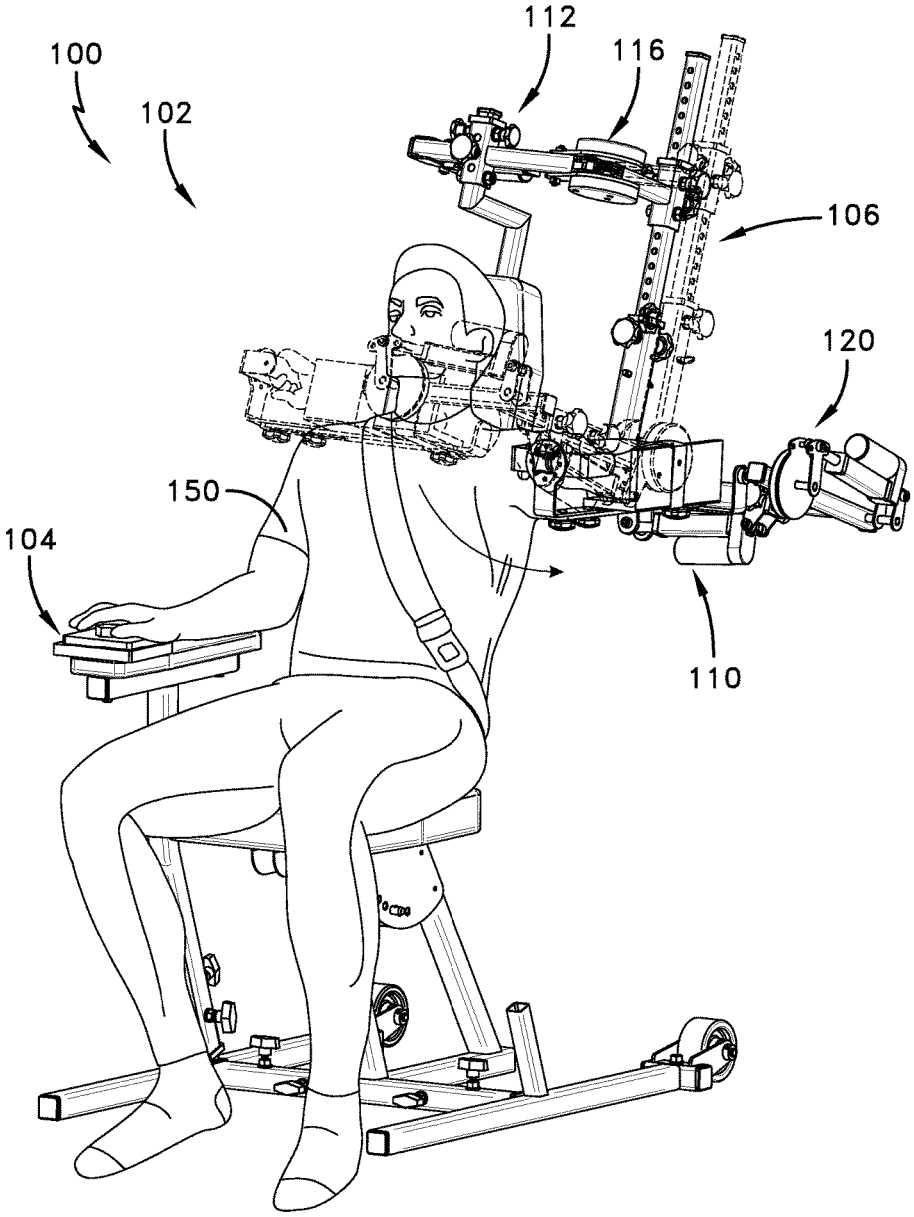
Figure 20:
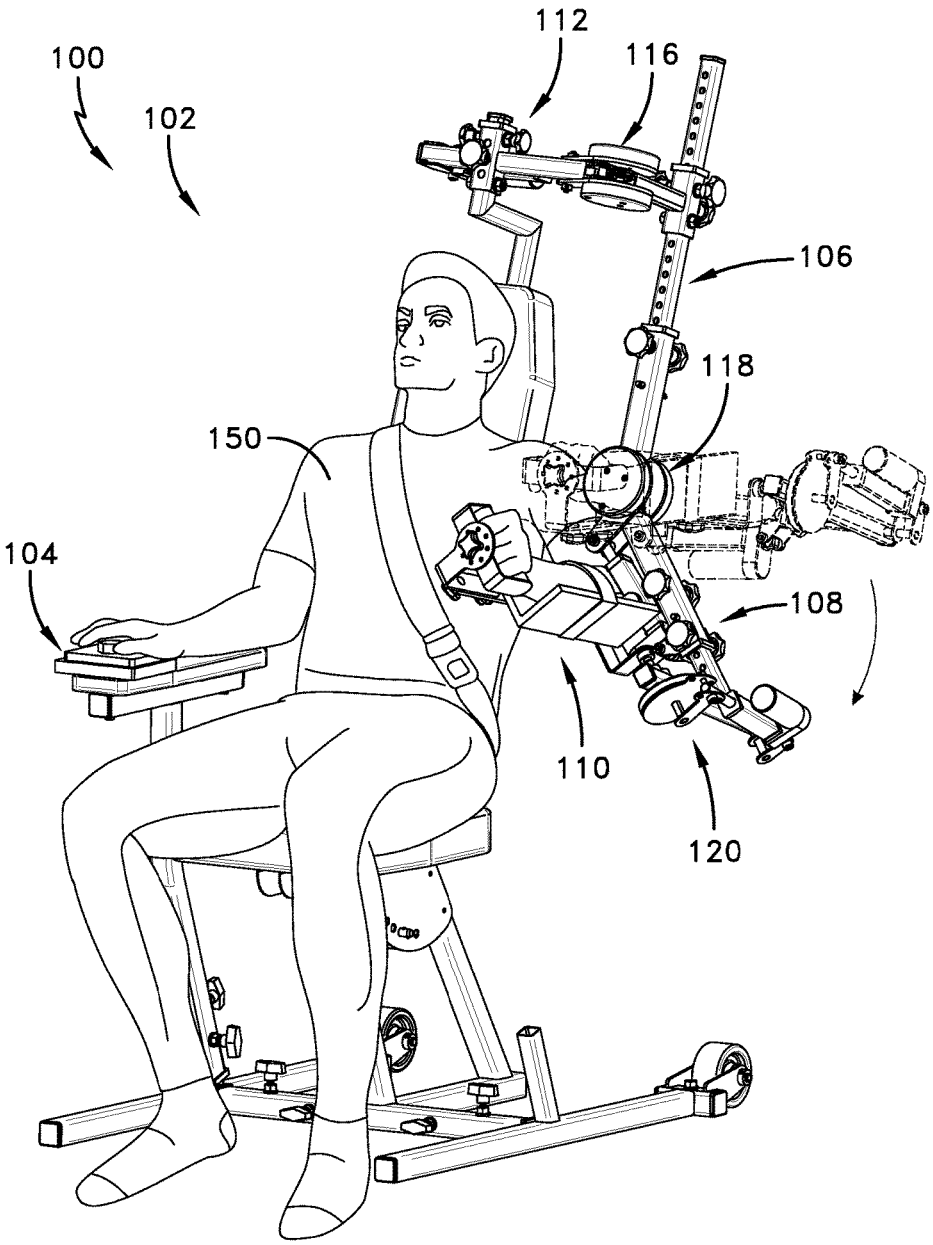
Figure 21:
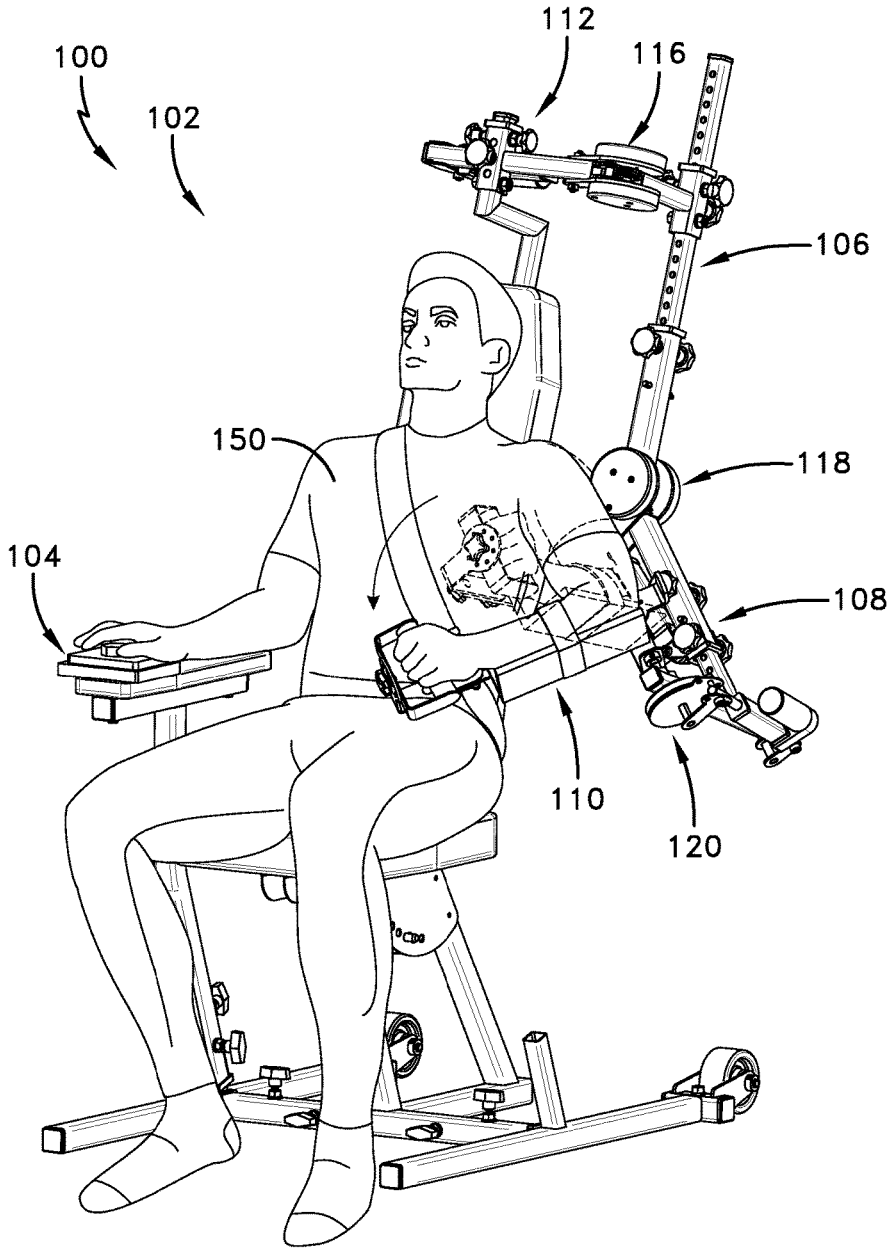
Figure 22:
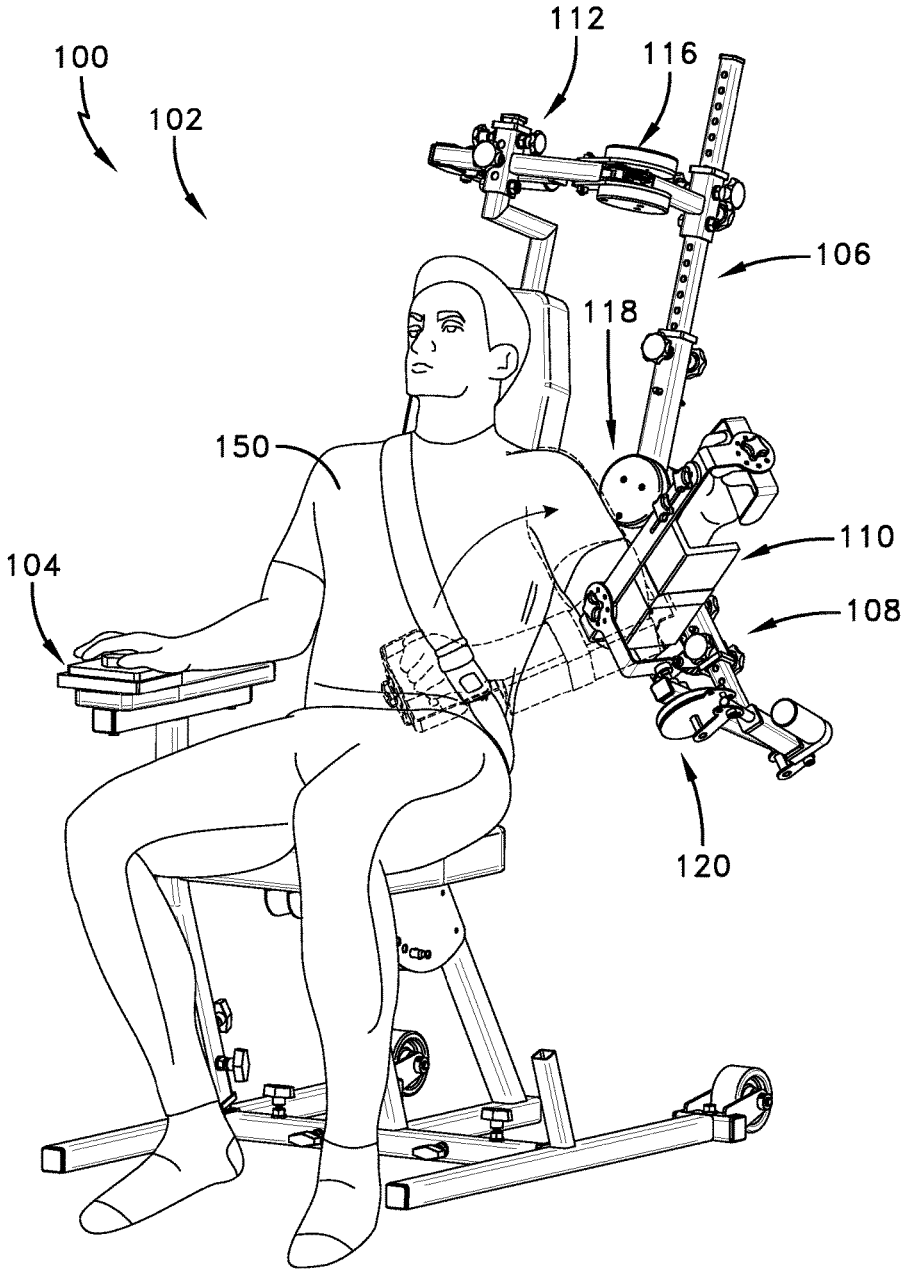

FIGS. 8-22 show a sequence of a patient 150 using the shoulder rehabilitation device 100 by operating controller 104 and securing a link member to an arm of a patient. For example, a link member may be secured to arm of patient 150 via a strap and an arm support. FIGS. 23-30 show a sequence of a patient using an alternative embodiment of the shoulder rehabilitation device 100, where the device has only two link member axes. Table 1-1 included herein indicates angles (in degrees) of the patient's arm for each figure. Each angle is relative to a conventional anatomic position where the patient's hands are located by their waist. In situations where horizontal rotation causes the motion to change from being abduction and adduction to forward flexion, and vice versa, N/A is indicated in a respective cell. For example, in FIG. 10 the patient's upper arm shifts from an abducted position to a forward flexed position, and as such N/A is indicated in the cell for Ad/Abduction. Further internal rotation is abbreviated "int" and external rotation is abbreviated "ext"

TABLE 1-1

(rotation values in degrees)

| FIG. | Horizontal | Ad/Abduction | Forward flexion | Internal/external rotation | Elbow flexion |
|---|---|---|---|---|---|
| 8 | 0 | 20 | N/A | 0 | 90 |
| 9 | 0 | 90 | N/A | N/A | 90 |
| 10 | 90 | N/A | 90 | 0 | 90 |
| 11 | 0 | 90 | N/A | 0 | 90 |
| 12 | 0 | 90 | N/A | 90 int | 90 |
| 13 | 0 | 90 | N/A | 90 ext | 90 |
| 14 | 90 | N/A | 90 | 90 ext | 90 |
| 15 | 90 | N/A | 90 | 0 | 90 |
| 16 | 90 | N/A | 140 | 0 | 90 |
| 17 | 90 | N/A | 70 | 0 | 90 |
| 18 | 90 | N/A | 90 | 0 | 90 |
| 19 | 0 | 0 | N/A | 0 | 90 |
| 20 | 0 | 45 | N/A | 0 | 90 |
| 21 | 0 | 45 | N/A | 45 int | 90 |
| 22 | 0 | 45 | N/A | 90 ext | 90 |
| 23 | 90 | N/A | 90 | 0 | 0 |
| 24 | 90 | N/A | 140 | 0 | 0 |
| 25 | 90 | N/A | 0 | 0 | 0 |
| 26 | 90 | N/A | 90 | 0 | 0 |
| 27 | 130 | N/A | 90 | 0 | 0 |
| 28 | −20 | 90 | N/A | 0 | 0 |
| 29 | −20 | 140 | N/A | 0 | 0 |
| 30 | −20 | 45 | N/A | 0 | 0 |

To further describe some of the motions in FIGS. 8-30, forward flexion and extension (FIGS. 16, 17, 18, 24, 25, and 26) may describe motion performed about a frontal axis of the shoulder joint with motion in a sagittal plane. Abduction and adduction (FIGS. 9, 20, 29, and 30) may describe motion performed about a sagittal axis of the shoulder joint with motion in a frontal plane. Horizontal abduction and horizontal adduction (FIGS. 10, 11, 14, 19, 27 and 28) may describe motion performed about a vertical axis with motion in a transverse plane. Internal rotation and external rotation (FIGS. 12, 13, 15, 21, and 22) may describe motion performed where a person's upper arm rotates inward or outward about an axis extending along the upper arm through the shoulder joint.

Figure 23:
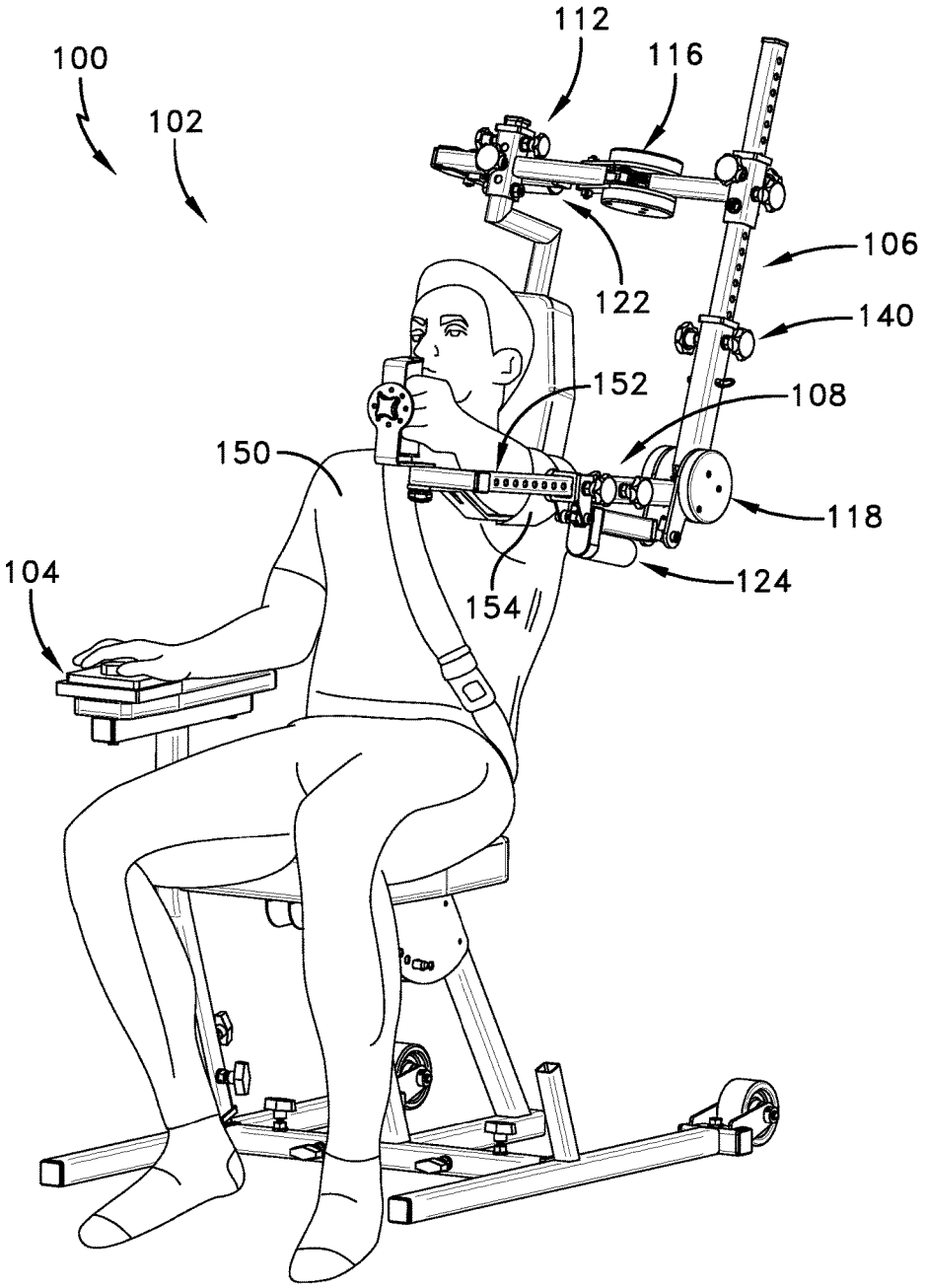
FIGS. 23-30 show a sequence of a patient using an alternative embodiment of the shoulder rehabilitation device.
Figure 24:
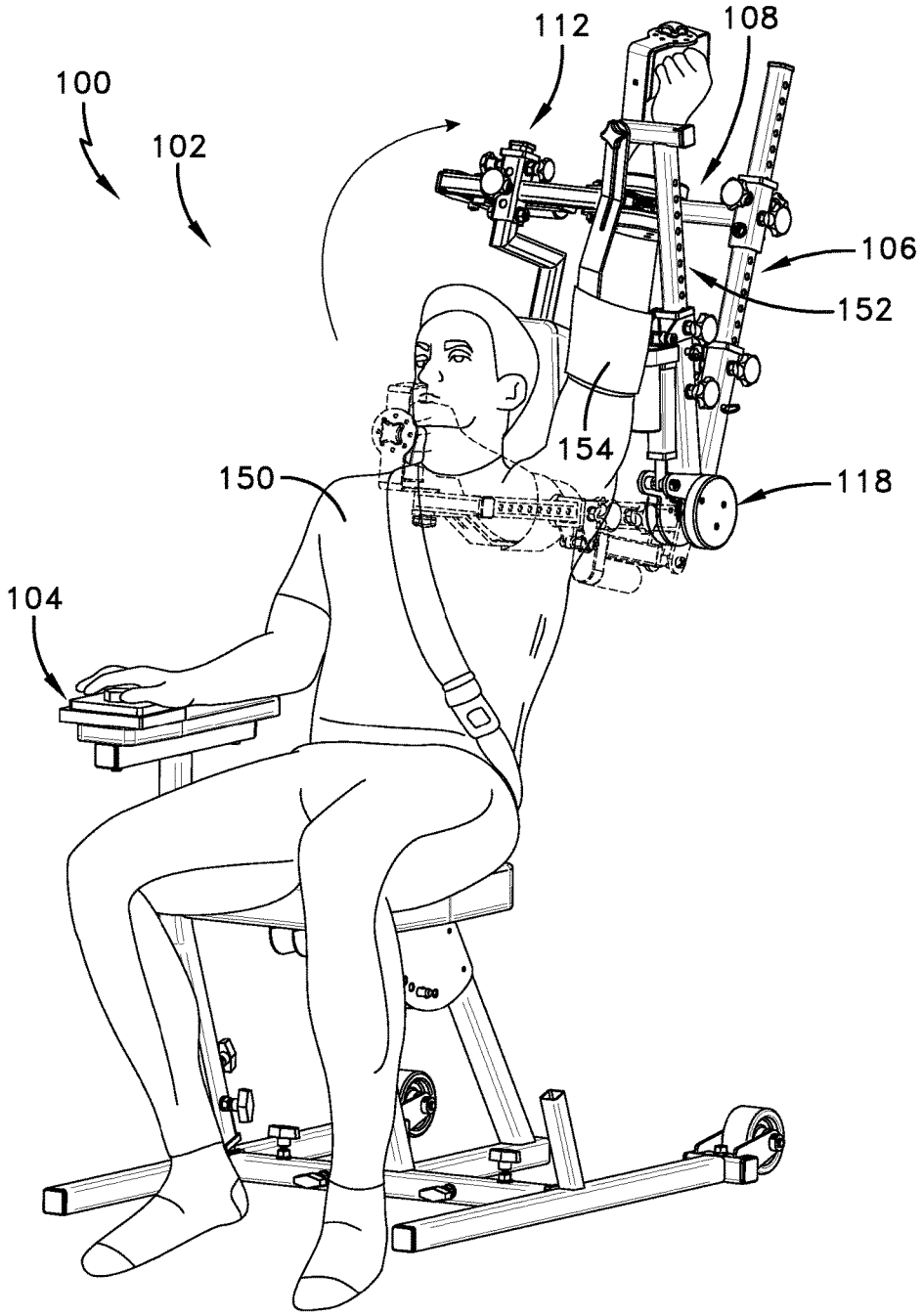
Figure 25:
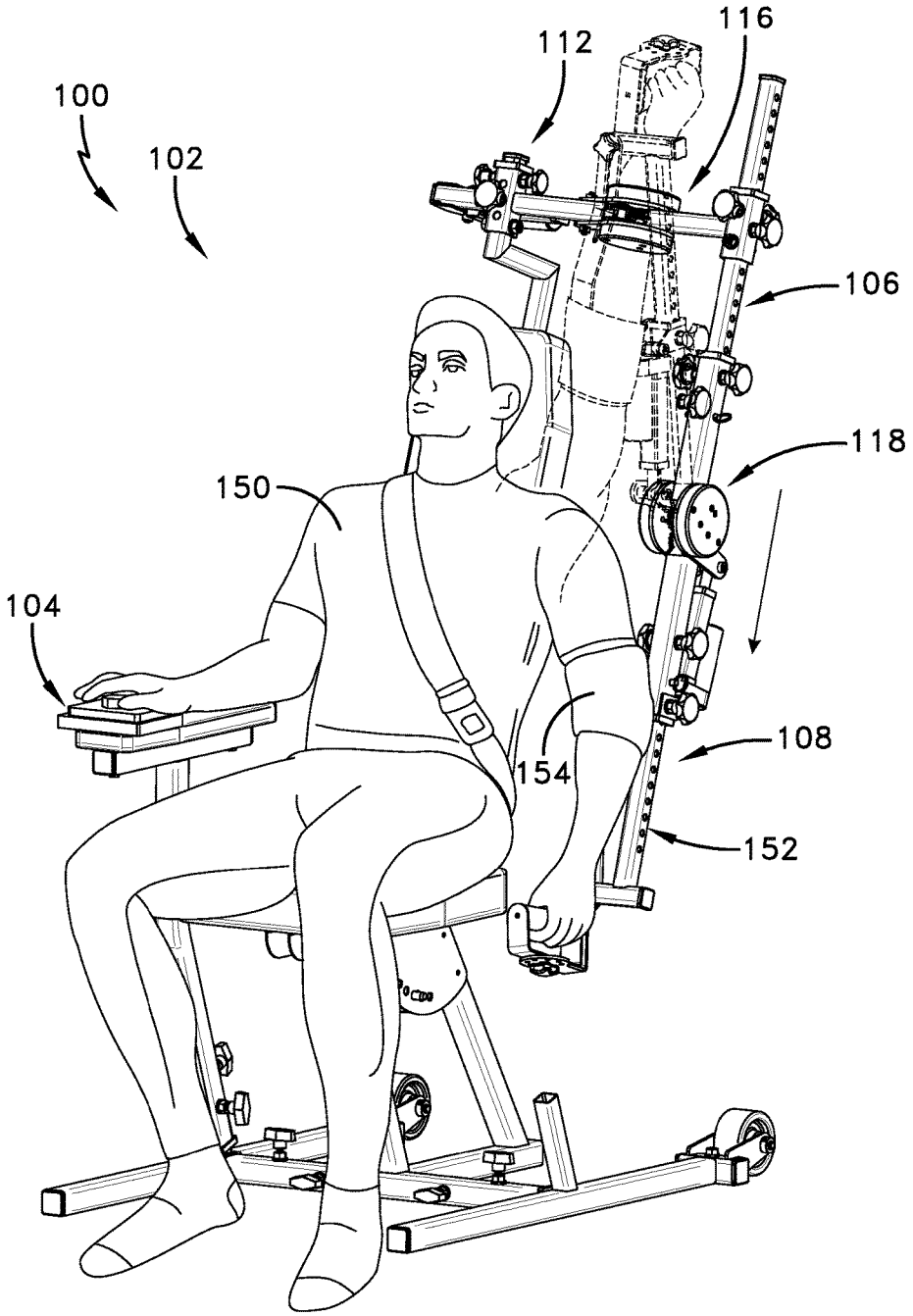
Figure 26:
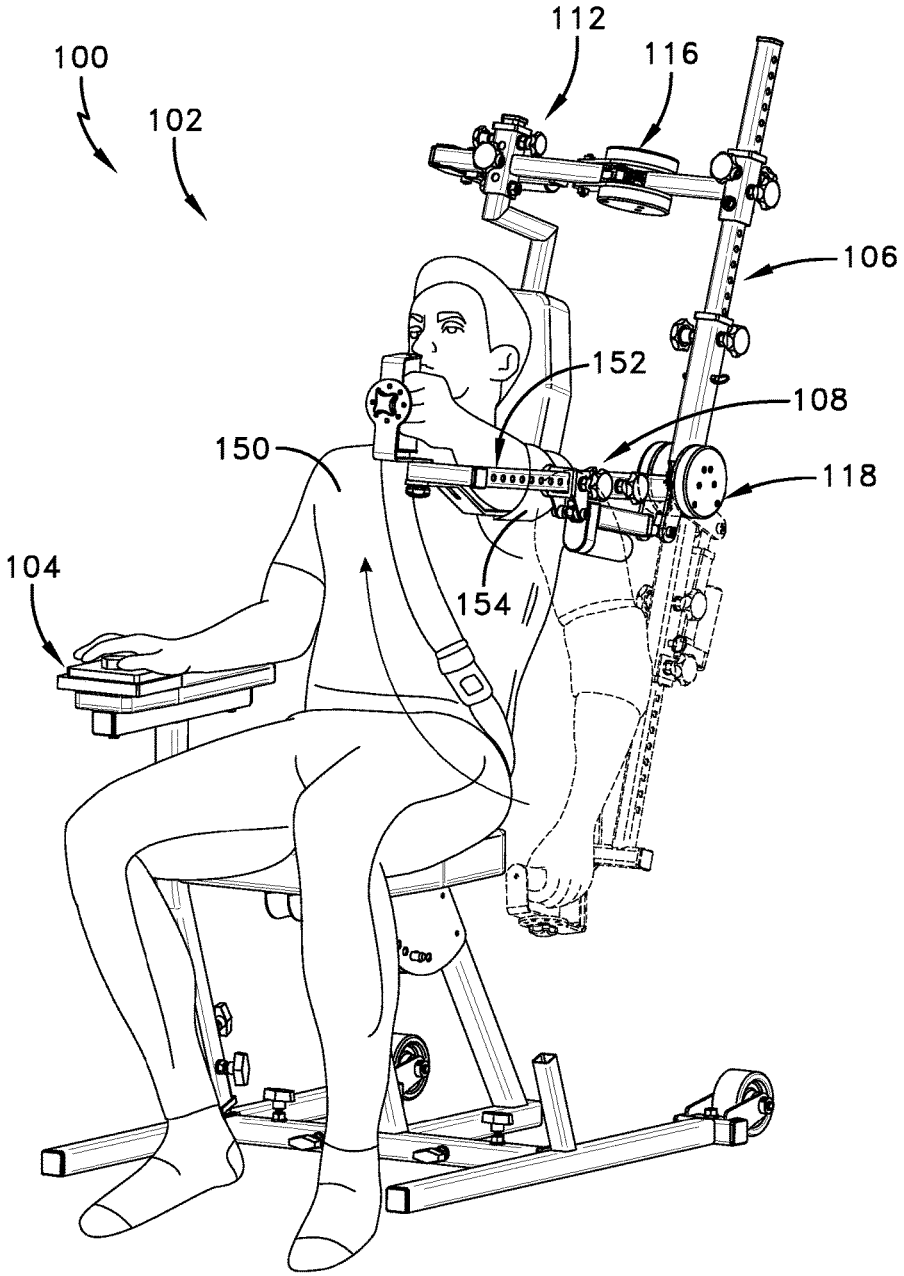

With respect to FIG. 23, the linkage 102 is modified by replacing the third link member axis 120 and third link member 110 with an alternative link member 152 which includes a strap 154. The alternative link member 152 is configured to remain fixed relative to the second link member 108, and as such rotates according to the rotation or displacement of the second link member 108. This alternative configuration creates a simpler two-axis system instead of the three-axis system shown in FIG. 1. In the embodiment shown in FIG. 23, it is contemplated that an additional axis may be provided to supinate or pronate the patient's forearm or shoulder, as shown in FIG. 5 by fourth axis 142 as an example.

It is to be understood that the rotation of one link member or rotatably driving one link member axis may cause another link member axis to displace or pivot, without actually driving the other link member axis. For example, in FIG. 10, the first link member 106 is rotated about first link member axis 116, causing second link member 108 to pivot substantially about the first link member axis 116 without causing the second link member 108 to rotate about the second link member axis 118. As such, the link members may each rotate independently from one another (via respective link member axes), even though rotating one link member may displace an orientation of another link member axis. In this way, by rotating one link member axis, another link member axis can be displaceable or re-oriented into a selectable fixed position. Further, one or more or all of the link member axes may be aligned with a shoulder joint of a patient during any motion or position. Further, although only some angles are shown in the figures, it is to be understood that the shoulder rehabilitation device may hold any link member at any position provided by the link member axes.

In some embodiments the methods described above may be carried out or executed by a computing system including a tangible computer-readable storage medium, also described herein as a storage machine, that holds machine-readable instructions executable by a logic machine (i.e. a processor or programmable control device) to provide, implement, perform, and/or enact the above described methods, processes and/or tasks. When such methods and processes are implemented, the state of the storage machine may be changed to hold different data. For example, the storage machine may include memory devices such as various hard disk drives or CD or DVD devices. The logic machine may execute machine-readable instructions via one or more physical devices. For example, the logic machine may be configured to execute instructions to perform tasks for a computer program. The logic machine may include one or more processors to execute the machine-readable instructions. The computing system may include a display subsystem to display a graphical user interface (GUI) or any visual element of the methods or processes described above. For example, the display subsystem, storage machine, and logic machine may be integrated such that the above method may be executed while visual elements are displayed on a display screen. The computing system may include an input subsystem that receives user input. The input subsystem may be configured to connect to and receive input from devices such as a mouse, keyboard or gaming controller. For example, a user input may indicate a request that certain task is to be executed by the computing system, such as requesting the computing system to display any of the above described information, or requesting that the user input updates or modifies existing stored information. A communication subsystem may allow the methods described above to be executed over a computer network. For example, the communication subsystem may be configured to enable the computing system to communicate with a plurality of personal computing devices. The communication subsystem may include wired and/or wireless communication devices to facilitate networked communication. The described methods or processes may be executed, provided or implemented for a user or one or more computing devices via a computer-program product such as via an application programming interface (API).

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. An end range of motion improving and reporting system, comprising an end range of motion improving device comprising:

a seat with a backrest;

a linkage connected to said backrest, the linkage including a support affixed to said backrest and disposed above said backrest;

a first link member affixed to said support;

a second link member supported on the first link member, the second link member configured for being secured to an arm of a patient and being rotatable about a second link member axis for rotating the arm of the patient about a shoulder joint of the patient through an arm range of motion, the second link member axis being displaceable into a selectable fixed position and maintaining the selectable fixed position during rotation of the second link member;

an actuator configured for rotating the second link member about the second link member axis through the arm range of motion; wherein the actuator is disposed on the second link member, the actuator pushes or pulls the second link member directly and is configured to mimic natural motion of a human body lifting a weight, wherein the second link member axis is provided by a polycentric gear system, the polycentric gear system includes a central gear and an outer gear wherein the outer gear rotates about the central gear when the actuator rotates a lever causing the rotation of the second link member from a first orientation of the polycentric gear system to a second orientation of the polycentric gear system, the lever coupled to the actuator and the outer gear and configured to be rotated when the actuator is activated, thereby anatomically imitating or matching rotation of the shoulder joint of the patient when the arm of the patient is rotated through the arm range of motion;

a controller configured for controlling the actuator for selectively rotating the second link member about the second link member axis through the arm range of motion;

one or more storage machines holding instructions executable by one or more logic machines to:

receive a set of parameters;

rotate the second link member based on the set of parameters;

record report data; and send the report data to a database.

2. The end range of motion improving and reporting system of claim 1, wherein the set of parameters includes a maximum angle and a minimum angle.

3. The end range of motion improving and reporting system of claim 1, wherein the set of parameters includes a maximum force.

4. The end range of motion improving and reporting system of claim 1, wherein the set of parameters includes time that the second link member is to be held at a particular position.

5. The end range of motion improving and reporting system of claim 1, wherein the instructions are executable to rotate the first link member independently about a first link member axis without causing the second link member to rotate about the second link member axis, or to independently rotate the second link member about the second link member axis without causing the first link member to rotate about the first link member axis.

* * * * *